US012152348B2

(12) United States Patent
Sáenz Löbsack

(10) Patent No.: US 12,152,348 B2
(45) Date of Patent: Nov. 26, 2024

(54) RAIL-SWITCHING UNIT

(71) Applicant: SPINSWITCH TECHNOLOGIES, S.L., Madrid (ES)

(72) Inventor: Daniel Sáenz Löbsack, Madrid (ES)

(73) Assignee: SPINSWITCH TECHNOLOGIES, Madrid (ES)

( * ) Notice: Subject to any disclaimer, the term of this patent is extended or adjusted under 35 U.S.C. 154(b) by 937 days.

(21) Appl. No.: 17/272,357

(22) PCT Filed: Oct. 4, 2019

(86) PCT No.: PCT/EP2019/076928
§ 371 (c)(1),
(2) Date: Mar. 1, 2021

(87) PCT Pub. No.: WO2020/070291
PCT Pub. Date: Apr. 9, 2020

(65) Prior Publication Data

US 2021/0340712 A1 Nov. 4, 2021

(30) Foreign Application Priority Data

Oct. 4, 2018 (EP) ..... 18382702

(51) Int. Cl.
*E01B 25/12* (2006.01)
*A63G 21/14* (2006.01)
*E01B 23/06* (2006.01)

(52) U.S. Cl.
CPC ..... *E01B 25/12* (2013.01); *A63G 21/14* (2013.01); *E01B 23/06* (2013.01)

(58) Field of Classification Search
CPC ..... E01B 25/12; E01B 23/06; E01B 25/06; E01B 7/08; A63G 21/14
See application file for complete search history.

(56) References Cited

U.S. PATENT DOCUMENTS 1,006,717 A * 10/1911 Brown ..... E01B 7/08 246/431
1,112,965 A * 10/1914 Anderson ..... E01B 7/08 246/433

(Continued)

FOREIGN PATENT DOCUMENTS

CN 108660871 A 10/2018
DE 9302337 U1 * 9/1993

(Continued)

*Primary Examiner* — S. Joseph Morano
*Assistant Examiner* — Cheng Lin

(57) ABSTRACT

A rail-switching unit, functioning singly or combined with other same units as part of a track-switching unit of a track-switching system of a vehicle-guiding system is provided. The rail-switching unit includes a rotatable ensemble including a rotatable-hub with attached switch-rails and auxiliary components and stationary elements including a main fixed-rail, branch fixed-rails and a supporting structure, wherein the branch fixed-rails are attached to common rails and the rotatable-hub selectively rotates to allow an engagement of each switch-rail simultaneously with the main fixed-rail and with a corresponding branch fixed-rail with a purpose of creating alternative continuous rail paths for vehicles to move through the rail-switching unit. A mechanism is applicable to mono/multi-railed tracks, to supporting/suspended vehicles, to traditional/rail-wrapping wheels-assemblies, to diverge/merge/cross-points, and to a wide variety of track-switching configurations.

20 Claims, 17 Drawing Sheets

(56) References Cited

U.S. PATENT DOCUMENTS

| | | | | |
|---|---|---|---|---|
| 3,313,243 | A | 4/1967 | Machinenfabrik | |
| 4,015,805 | A | 4/1977 | Friesenbichler | |
| 4,030,422 | A | 6/1977 | Pasquan | |
| 5,499,583 | A * | 3/1996 | Blumel | E01B 25/34 104/130.05 |
| 6,273,000 | B1 * | 8/2001 | Lamoreaux | E01B 25/12 104/130.05 |
| 7,997,540 | B2 | 8/2011 | Vance et al. | |
| 2010/0147183 | A1 * | 6/2010 | Weissbrodt | B61J 1/02 246/415 R |

FOREIGN PATENT DOCUMENTS

| | | | | |
|---|---|---|---|---|
| GB | 1404648 | A | 9/1975 | |
| GB | 2516706 | A | 2/2015 | |
| WO | WO-2006133468 | A1 * | 12/2006 | B61B 13/04 |

* cited by examiner

RAIL-SWITCHING UNIT

CROSS REFERENCE TO THE RELATED APPLICATIONS

This application is the national stage entry of International Application No. PCT/EP2019/076928, filed on Oct. 4, 2019, which is based upon and claims priority to European Patent Application No. 18382702.1, filed on Oct. 4, 2018, the entire contents of which are incorporated herein by reference.

BACKGROUND

The present invention relates generally to circulation of vehicles along a guideway conveying goods or passengers with transportation or amusement ride enjoyment purposes. More particularly, the present invention relates to methods and apparatus to allow selective changes of paths to be followed by vehicles conveyed along a guideway, achieved by means of switching segments of track at diverge-points (divergence of one single path into many), at merge-points (convergence of many paths into a single one) or at cross-points (combination of diverge-points and merge-points).

Transport systems based on guideways, such as conventional trains, monorail trains or many automated people movers, need means to choose between alternate directions of movement. Changing of directions can be done through vehicle-activated (on board) steering mechanisms or through central-activated (wayside) guideway modification mechanisms, being the latter option the most preferred when a high level of stable and continuous centralized control is needed.

Switching of the guideways is commonly achieved using methods and systems that imply mechanical movement of multiple rails or whole sections of the guideway. These methods and systems are often slow, complex, difficult to operate, costly to maintain, restricted in practice to only two positions, requiring too much installation space, and considerably vulnerable to critical failure, which makes them objectively perceived as costly, inefficient, inconvenient or of insufficient utility value unless performance and reliability requirements are relaxed, or unless their use is limited to very specific applications.

In the specific case of widespread railways and other mass-transit systems with large and heavy vehicles, track-switching systems (also called track points) are especially critical because of the potential significantly large damage associated to the risk of derailment. In these applications, a fast, compact and reliable switch device offering more than the two standard states (straight route and turnout route) could imply miscellaneous improvements in the form of reduced costs, abated risks, increased capacities and improved operation speeds.

In the specific case of some modem or nascent applications such as Personal Rapid Transit (PRT) or other Automated Guideway Transit (AGT) systems, a fast and reliable track-switching technology could not only overcome many disadvantages and drawbacks, but also significantly increase their capacity and, hence, make these new and disruptive transit systems definitively feasible under a medium or high scale of transport demand. The same line of thought applies to some track-based materials/products handling systems used in factories or other industrial installations.

In the specific case of amusement rides in attraction/theme parks or the like, fast and reliable guideway switching systems that are also compatible with wheels-assemblies presenting rail-wrapping profiles, could not only overcome many drawbacks, but could also lead the industry into a new generation of roller coasters or similar attractions with a substantial improvement of their capacity, customer enjoyment value and consequent business profitability Some attempted solutions have tried to overcome the mentioned drawbacks and disadvantages and/or to cover the mentioned potential opportunities, but only partially, insufficiently or, in practice, inconveniently. Following there are some examples:

- U.S. Pat. Nos. 1,112,965 or 4,015,805 relate to switch track sliding devices, and present systems that allow switching between two tracks by pushing and sliding a pair of switch-rails into engagement position with stock rails.
- Patents US 2010/0,147,183 and U.S. Pat. No. 6,273,000 relate to transversal-axis rotary-guided devices, and present systems that allow switching between two tracks on a horizontal plane through the rotation or pivoting of whole-track segments about a vertical axis placed transversally to the main track path.
- U.S. Pat. Nos. 802,049 and 7,997,540 relate to longitudinal-axis rotary-guided devices, and present systems that allow switching between two tracks by means of a one single mechanism per track (instead of mechanically independent track-switching units for each rail of the track) based on a barrel or tubular member that, having whole-track segments attached, rotates about an axis placed longitudinally and parallel to the main track path.
- U.S. Pat. No. 3,313,243 also relates to longitudinal-axis rotary-guided devices in which a whole track segment is attached to a barrel, but specifically presenting a two switch-rails system designed for diverge-points track-switching applications of 'suspension rails and monorails' laid out on a horizontal plane.
- Patent GB 2,516,706 relates to special junctions and vertical-transversal movement and presents a system to switch between two tracks on a horizontal plane by means of a vertical and transversal movement of a pair of switch-rails so as to engage them with corresponding stock rails using a novel junction profile configuration.
- U.S. Pat. No. 4,030,422 relates to switching of guideway with vertical layout and presents a system for the switching of guided vehicles between two tracks that are placed vertically, one above the other.
- Patent CN 18,660,871 relates to a single-track stack assembly for a straddle-type monorail railway of a monorail track presenting a rotatable ensemble that always includes a branch switch-rail connected to a rolling gear and that, lacking a rotatable hub, comprises switch-rails directly attached to both sides of a straight switch-rail that is traversed by the axis of rotation of the rotatable set; as it is defined, the referred invention is restricted to applications with rails that are monorails, not rails of bi-railed tracks, and that have rectangular sections with one top longitudinally-flat rolling surface and one lateral guiding surface, and to applications of diverging switch-points with a horizontal layout.
- Patent GB 1,404,648 discloses monorail track assemblies for transport systems where a monorail track with a rail that has a rectangular cross-section or a near-vertical flanks section is used by vehicles with a lateral guidance; thus, it is specifically devised for transport systems that use tracks of only one rail, not two, and for vehicles that need additional guiding contact only with one of the lateral surfaces of the rails, as it is the case of traditional railways. It is defined as providing alternative paths from a section of a main track, that is specifically horizontal, into other track sections, that are also specifically horizontal; hence, it is concretely devised to address switch-points in a horizontal layout where divergence from the main track can only be horizontal and not possibly also vertical; this is understandable as vertical layouts imply having the main rail path and moving vertical vehicle-weight bearing forces not placed right above the rotation axis but horizontally offset from it, circumstance that, in turn, also implies not only different vehicle-passing clearance requirements, but also quite different physical dynamics to rotate the switch-rails and to maintain them stably in their engagement positions. The assembly disclosed presents a clear unbalanced distribution of masses of the rotatable ensemble relative to its rotation axis as it has all its switch-rails placed at one side of the rotation axis and confined within a cross-section angular scope of a maximum of 1100 degrees. This significant dealignment between the axis of rotation of the rotatable ensemble and its principal axis of moment of inertia implies rotational movements that are quite difficult to drive and to control as they require non-constant highly variable forces, positive (pushing), zero, and negative (retaining), to drive the pivotal movement of the rotatable ensemble from one extreme of the angular scope to the other, this is, with the center of mass pivoting left-right above the axis of rotation, even when seeking minimal angular movement and minimal horizontal displacement of the center of mass relative to the axis of rotation.

Its pivoting of the rotatable ensemble via the shortest angular path, this is, above and not below the axis of rotation, may be cause of volumetric clearance conflicts due to moving bodies of the switch-rails sticking out above the horizontal paths plane as they are rotated into or out of their engagement positions.

Its specific close confinement of the switch-rails within the rotatable ensemble is a technical characteristic that makes the invention invalid for more complex rail profiles such as those of common roller coasters which require top, one-lateral and bottom side wrapping of the rails by the wheels-assemblies.

In relation to these last documents cited, it is important to state that, in general, known monorail-switching unit solutions that are specific to monorail transport systems, are not suitable for use, simply combined with other same monorail-switching units, as rail-switching units of a bi-railed track-switching unit. A bi-railed track-switching unit is considerably more complex than simply two mono-rail switching units put together, because of the following reasons:

A bi-railed track switching unit requires precise and delicate execution of synchronous and congruent switching actions on both its rail-switching units.

A bi-railed track switching unit demands different but specifically congruent configurations and shapes (e.g. curvatures profile, longitudinal length, distal length) of its rail-switching units, depending on the required curvature and banking of the track and rail paths on which each track-switching unit with its rail-switching units acts on, as well as on the configuration of the wheels-assembly (e.g. inside/outside position relative to tracks, left/right position relative to rails, extent of rail-wrapping of wheels) and the section of the rails supporting the vehicles.

A bi-railed track switching unit demands resolving significantly more clearance problems in order to avoid interferences among switch-rails and between switch-rails and fixed-rails and structures holding them, not only within the volumetric scope of a same one-rail switch, but also within the scope of the other rail-switching units belonging to a same bi-railed track-switching unit.

Due to all the above, a well-functioning bi-railed track switching unit requires a pair of rail-switching units that are especially compact, fast and reliable, and specifically shaped and configured to inter-connect and congruently work with each other.

In sum, given the current state of the art, by means of the present invention, it should be possible to overcome many of the general drawbacks and disadvantages of the known guideway switching systems and methods, and fundamentally those associated to their poor physical dynamics and resultant difficulties to easily and efficiently drive and control their movements. Furthermore, this invention may imply a significant technological contribution to improve common railways switching, to boost passengers-capacity in amusement rides, and to facilitate the definitive implementation of revolutionary rapid mass transit systems.

The present invention provides improved methods and apparatus to allow selective changing of paths followed by goods or passengers conveyed along guideways, such methods and apparatus being applicable to switching of guideways using vehicles. In the present description the term "vehicles" should be broadly understood as any physical entity containing or grouping goods or passengers to facilitate their movement along a guideway, such as trains, trolleys, personal rapid transit vehicles (pods), wagons, carriage vehicles, etc.

A more particular object of the invention is to provide such methods and apparatus as can be used in applications requiring mechanisms with reduced footprint, lower weight and lower complexity in terms of fewer moveable mechanical guidance components. A very specific object of the invention is to provide a method and apparatus requiring switch-rails driving forces of minimal magnitude and minimal variability to maximize energy-efficiency, precision and ease of control of the device.

A further object of the invention is to provide such methods and apparatus as can be used in applications requiring fast operation, minimal headway and minimal distance between successive diverge-points or merge-points.

A further object of the invention is to provide such methods and apparatus in applications requiring switching into/from diverging/converging track paths that diverge/converge on vertical or inclined planes, paths that can be more than two in number, and paths that may have different curvature profiles.

A further object of the invention is to provide such methods and apparatus in applications with rolling, sliding or gliding mechanisms that require wrapping of a significant part of the perimeter of the rails.

A still further object of the invention is to provide such methods and apparatus in applications that could require vehicle switching not only at guideway points where one single track splits into many tracks (or diverge-points), but also at merge-points (guideway points where several tracks converge into a single one), or at cross-points (configured as combination of diverge-points and merge-points).

SUMMARY

The solution involves—in a first embodiment—a rail-switching unit, for use to switch only one rail segment at a time, functioning either singly such as in a mono-rail track-switching unit or combined with other same units such as in a multi-rail track-switching unit, wherein the rail-switching unit is part of a track-switching unit, and the track-switching unit is part of a track-switching system, and the track-switching system is part of a vehicle-guiding system comprising vehicles and guideways, standard stationary rails or "common-rails", special stationary rail segments or "fixed-rails", and special moveable rail segments or "switch-rails", the rail-switching unit comprises:

a rotatable set of components or "rotatable ensemble", and a stationary set of components or "stationary set";

the rotatable ensemble further comprising:

a "rotatable hub", a set of two, three or more switch-rails, a set of auxiliary components to facilitate attachment of the switch-rails to the rotatable hub and/or to optimize the physical attributes of the rotatable ensemble and/or to facilitate precise control of the rotational movement of the rotatable ensemble;

the stationary set further comprising:

one main fixed-rail, a set of two, three or more branch fixed-rails, a supporting structure;

wherein the main fixed-rail is solidly fixed to a common-rail at the "external end" of the main fixed-rail or end of the main fixed-rail that is furthest in distance from the rotatable ensemble and opposite to the "internal end" of the main fixed-rail;

wherein the branch fixed-rails are solidly fixed to common-rails at their "external ends" of the branch fixed-rails or ends of the branch fixed-rails that are furthest in distance from the rotatable ensemble and that are opposite to the "internal ends" of the fixed-rails, wherein, in a normal operating mode, the number of switch-rails is equal to the number of branch fixed-rails, wherein each of the switch-rails is designed to allow its "activation" or engagement into a stationary operative position called "active position" of alignment and/or connection with a corresponding branch fixed-rail, wherein each of the switch-rails is fixedly attached at a distance from an axis of rotation of the rotatable hub so that rotation movement of the rotatable hub about the axis of rotation allows selective activation of each of the switch-rails with a corresponding fixed-rail, wherein activation of any one of the switch-rails involves aligning and/or connecting a so called "main end" with the internal end of the main fixed-rail and aligning and/or connecting a so called "branch end" with the corresponding internal end of a corresponding branch fixed-rail with the purpose of bi-directionally conveying or guiding vehicles through the rail-switching unit, this is, either from the main fixed-rail into any of the branch fixed-rails, or from any of the branch fixed-rails into the main fixed-rail, or simultaneously allowing both directions of movement, wherein the rail-switching unit is configured so that the internal branch ends of the branch fixed-rails are separated at fixed distances between each other providing the necessary clearance spaces for the vehicles to be directed adequately and avoiding inadequate interferences through the rail-switching unit, wherein the rail-switching unit is configured so that the internal branch ends of the branch fixed-rails do not necessarily have to form a plane and, if so, the plane they form does not necessarily have to be of horizontal nature, wherein the rotatable ensemble is in principle configured in a compact and center-of-mass balanced way to optimize its moment of inertia about the axis of rotation, and wherein the supporting structure solidly supports, consolidates and protects elements comprised within the rail-switching unit and, if appropriate, also firmly attaches them to the ground and/or to the common guideway structures.

The invention can be used with mono-railed, bi-railed and multi-railed tracks, being also applicable to transport solutions with vehicles that fundamentally circulate above the rails (running on the rails) or to transport solutions with vehicles that circulate below the rails (being suspended from the rails).

The invention may also be used with 'T-shaped' monorail guideways that require vehicle-interacting surfaces at top, outer-lateral and/or bottom sides at both left and right ends of the monorail (such as those guiding magnetic-levitated vehicles), by using not one but two rail-switching units each addressed to switch one lateral side of the monorail track.

Since the invention is not limited to horizontal planes (or any plane) and allows two, three or more switch-rails, a more flexible switching of vehicles is possible. The invention is neither limited to any particular (or identical) curvature of the switching rails further allowing freedom of switch point design.

The invention, when applied to track-switching problems on diverge-points, provides a solution where the support means and drive means may be disposed at any side of the fixed rails. The invention provides a solution where the axis of rotation might be at any side of the fixed rails.

The invention may include a shaft-arrangement that might engage either a live-shaft, a stationary dead-shaft, or a combination of both.

The invention is applicable to multi-railed track diverge-points and merge-points, as well as to cross-road points when considering them as a combination of diverge-points and merge-points.

The invention is applicable not only to diverge-points (vehicle moving from trunk rails into branch rails), but also to merge-points (vehicle moving from branch rails into a trunk rail).

In a second embodiment, the main fixed-rail and the switch-rails are shaped and/or may be configured to allow engagement between the internal end of the main fixed-rail and any of the main ends of the switch-rails by means of mating profiles at main ends or "main mating profiles", and/or wherein the branch fixed-rails and the switch-rails are shaped and/or configured to allow engagement between the internal ends of the branch fixed-rails and the corresponding branch ends of switch-rails by means of mating profiles at branch ends or "branch mating profiles", wherein a main mating profile comprises a main mating surface referred as "female" that is present on the internal end of the main fixed-rail, and a main mating surface referred as "male" that matches the "female" surface and that can be present on any of the main ends of the switch-rails;

wherein a branch mating profile comprises:

a branch mating surface referred as "female", present on any of the internal ends of the branch fixed-rails;

and a branch mating surface referred as "male" that matches a corresponding "female" surface, and that can be present on any of the branch ends of the switch-rails, wherein a branch or main mating surface that is referred as female does not necessarily have to be mainly concave and a branch or main mating surface that is referred as male does not necessarily have to be mainly convex, and wherein the mating profiles are configured to allow firm connection between switch-rails and fixed-rails and configured to facilitate smooth movement of the switch-rails into and out of their positions of engagement with corresponding fixed-rails.

In a third embodiment, at least one of the mating profiles may be designed and configured to facilitate halting the continuity of the rotational movement of the rotatable ensemble when a certain active position of a switch-rail has been reached, to facilitate maintaining the reached active position of the switch-rail, and to facilitate the reversal of the direction of the rotational movement of the rotatable ensemble in order to come out of the reached active position of the switch-rail, and/or wherein at least one of the mating profiles is configured to facilitate smooth and controlled movement of the switch-rails into and out of their active positions of engagement with the corresponding branch fixed-rails preferably by means of specific shapes of the male and female mating surfaces and/or by means of using one or more sets of mating profile bearings, these preferably being sets of bearings and/or other auxiliary mechanisms to reduce friction and/or control relative movement between surfaces which are integrated with one or both of the mating surfaces.

In a fourth embodiment, the set of switch-rails may comprise:

- a switch-rail with a basically straight shape and referred as "straight switch-rail",
- a first switch-rail with a basically curved shape and referred as "first curved switch-rail",
- and a second switch-rail with a basically curved shape and referred as "second curved switch-rail";

wherein the set of branch fixed-rails may comprise:

- a fixed-rail shaped and/or configured to be connected with the straight switch-rail and referred as "straight-path branch fixed-rail",
- a fixed-rail shaped and/or configured to be connected with the first curved switch-rail and referred as "first curved-path branch fixed-rail",
- and a fixed-rail shaped and/or configured to be connected with the second curved switch-rail and referred as "second curved-path branch fixed-rail";

wherein when the straight switch-rail is rotated into active position, it engages simultaneously on a main end with the main fixed-rail and on a branch end with a corresponding straight-path branch fixed-rail, wherein when the first curved switch-rail is rotated into active position, it engages simultaneously on a main end with the main fixed-rail and on a branch end with a corresponding first curved-path branch fixed-rail, wherein when the second curved switch-rail is rotated into active position, it engages simultaneously on a main end with the main fixed-rail and on a branch end with a corresponding second curved-path branch fixed-rail, wherein all engagements between switch-rails (straight switch-rail, first curved switch-rail and second curved switch-rail) and corresponding fixed-rails (straight-path branch fixed-rail, first curved-path branch fixed-rail and second curved-path switch-rail respectively) have the purpose of providing a continuous running surface and/or a continuous connection between the switch-rail and the corresponding fixed-rail in a bi-directional way (in one direction, in the other direction, or in both directions), wherein, in order to optimize the solidity and compactness of the ensemble of the rotatable hub and the switch-rails, the first and second curved switch-rails are preferably configured forming approximate parallel planes, and wherein, in order to facilitate a simplified engagement of the switch-rails with the main fixed-rail, the main ends of the switch-rails are configured within a same plane and at a same perpendicular distance from the axis of rotation, and the main ends of the curved switch-rails are configured in approximate diametrically opposite positions from each other and in relation to the axis of rotation.

In a fifth embodiment, the first curved switch-rail and the second curved switch-rail may have different curvature profiles.

In another embodiment, the rail-switching unit may further comprise a shaft arrangement to facilitate the rotational movement of the rotatable ensemble wherein the rotatable hub is solidly supporting the switch-rails in order to accurately place them into their active positions by means of selective rotational movements about a fixed axis longitudinally traversing the shaft arrangement.

In a sixth embodiment, the rail-switching unit may further comprise an actuator arrangement to provide and transmit the necessary drive for the rotational movement of the rotatable ensemble, wherein the actuator arrangement may be able to actuate on only one rotatable ensemble or simultaneously on two or more rotatable ensembles of different rail-switching units.

In a seventh embodiment, the rail-switching unit may further comprise a mechanism to block angular positions of the rotatable ensemble, named "position-blocking mechanism", to assure and/or reaffirm precision and solidness of the engagement between switch-rails and fixed-rails by allowing firm, fast and timely blocking and unblocking of the rotatable ensemble by means of a multi-point latch mechanism operated by a control system and/or mechanically linked with the angular movement of the rotatable hub, wherein the position-blocking mechanism may be able to operate on only one rotatable ensemble or on two or more rotatable ensembles of different rail-switching units.

In an eighth embodiment, the rail-switching unit may further comprise an engagement-guiding system with the purpose of providing controlled rotational movement of the rotatable hub and the switch-rails during transitional phases, and/or of accurately guiding the ends of the switch-rails into precise and/or smooth engagement with their corresponding ends of the fixed-rails In a ninth embodiment, the engagement-guiding system may comprise:

- a set of one or more stationary engagement guides,
- a set of one or more engagement-guiding bearings;
- and a set of one or more rotatable engagement components;

wherein the engagement-guiding bearings, which are preferably cylindrical roller bearings or needle roller bearings and/or any other auxiliary mechanisms to reduce friction and/or control relative movement between surfaces, are configured to facilitate the interaction between stationary surfaces of the stationary engagement guides and moving surfaces of the rotatable engagement components to accurately control their relative motion and/or to reduce the potential friction and constraint between them, with the ultimate objective of achieving a fast, smooth and precise engagement between switch-rails and corresponding fixed-rails, and wherein the rotatable engagement components provide surfaces to interact with the stationary engagement guides directly or by means of engagement-guiding bearings, are solidly fixed to the rotatable ensemble, integrate with the rotatable hub and/or the switch-rails and/or the auxiliary components, and may integrate with mating profile surfaces at the ends of the switch-rails.

In a tenth embodiment, the set of stationary engagement guides may comprise:

one or more stationary engagement guides placed in outermost rings and presenting guiding surfaces with inward curving—referred as "concave guiding surfaces", and/or one or more stationary engagement guides placed in innermost rings and presenting guiding surfaces with outward curving—referred as "convex guiding surfaces";

wherein the concave or convex guiding surfaces do not necessarily have to be continuous, and if so, they have the general shape of an arch covering up to approximately 180 degrees, wherein the concave or convex guiding surfaces are fundamentally concentric and share the same axis of rotation of the rotatable hub, and wherein the concave or convex guiding surfaces that are adjacent to an internal end of a branch fixed-rail are solidly fixed to it and configured to allow smooth and precise engagement of the end of the switch-rail (and its mating profile if present) with the corresponding end of the fixed-rail (and its mating profile if present).

In an eleventh embodiment, with the purpose of minimizing slacks, facilitating deceleration of the rotational movement of the rotational ensemble, and thus improving the final speed and accuracy of the connections between fixed-rails and switch-rails when reaching active positions, at least one of the concave guiding surfaces may have a curvature profile with a curvature radius that is slightly and progressively reduced at one or both end sections of the stationary engagement guide and/or at the mid-section of the stationary engagement guide, and/or at least one of the convex guiding surfaces has a curvature profile with a curvature radius that is slightly and progressively increased at one or both end sections of the stationary engagement guide and/or at the mid-section of the stationary engagement guide.

In a twelfth embodiment at least one rotatable engagement component may be shaped integrating the matching profiles of different branch ends of switch-rails and providing surfaces that allow simultaneous interaction with a concave guiding surface and with a convex guiding surface.

In a thirteen embodiment, a track-switching unit used to allow controlled and selective switching of a segment of a track or guideway, the track-switching unit comprises:

one or more rail-switching units of the previous claims, a set of components linked to or part of an electronic operating control system, a supporting structure;

wherein the number of rail-switching units is equal to the number of rails that compose the track segment affected by the track-switching unit, wherein the track-switching unit is configured so that the internal branch ends of the branch fixed-rails of the rail-switching units do not necessarily have to form a plane and, if so, the plane they form is not necessarily of horizontal nature, wherein when comprising more than one rail-switching unit and in their normal operating mode, the rail-switching units are meant to be operated in a simultaneous way, but not necessarily by means of mechanical links between them, and not necessarily in a precise synchronous manner, wherein when comprising more than one rail-switching unit and in their normal operating mode, the rail-switching units are meant to be operated congruently so as to create viable paths of continuity for the vehicles to move along the track, and wherein the supporting structure solidly supports, consolidates and protects elements comprised within the track-switching unit and, if appropriate, also firmly attaches them to the ground and/or to the common guideway structures or integrates them with the supporting structures of the rail-switching units.

In a fourteenth embodiment, the guideway rails may be supported from the outside of the track, and/or the sets of wheels of the wheels-assemblies are wrapped around the rails from the inside of the track; and/or the width of the track and/or the maximal width of the vehicle body is adapted without considering the wheels-assemblies or a vehicle body width, so that the vehicle, when directed through a track-switching unit, is able to fit within the horizontal gap between two rails of a same track and pass through the track-switching unit without any inadequate interferences; and/or clearance gaps above and below the rails are minimized fundamentally at the internal ends of the branch fixed-rails; and/or the top height of the wheels-assembly is minimized to the height of its top wheels; and/or the bottom height of the wheels-assembly is minimized to the height of its bottom wheels, whilst always allowing the wheels-assemblies to pass through the track-switching unit without any inadequate interferences; and/or the tracks in diverging/merging points is progressive vertical distanced/approximated avoiding any lateral turns of the tracks in a portion of the guideway referred as "straight-guideways segment" that is linked to the branch fixed-rails and thus is adjacent to the track-switching unit; and/or the longitudinal length of straight-guideways segments is reduced by means of minimizing the top height of the vehicle body and/or minimizing the bottom height of the vehicle body; and/or the segments of guideway adjacent to the track-switching unit and/or the general common guideway and/or vehicles running through the track-switching unit are adapted as a consequence of directly or indirectly applying some or all of the above limitations.

The fourteenth embodiment may correspond to a track-switching unit further comprising:

a set of design guidelines, adaptations made to segments of guideway adjacent to the track-switching unit that are consequence of directly or indirectly applying some or all of the design guidelines, adaptations made to the general common guideway that are consequence of directly or indirectly applying some or all of the design guidelines, adaptations made to vehicles running through the track-switching unit that are consequence of directly or indirectly applying some or all of the design-guidelines;

wherein the track-switching unit has been adapted by directly or indirectly applying some or all of the design guidelines, wherein a first design guideline comprises:

supporting of the guideway rails from the outside of the track and wrapping of the sets of wheels of the wheels-assemblies around the rails from the inside of the track;

wherein a second design guideline comprises:

adapting the width of the track and/or adapting the maximal width of the vehicle body without considering the wheels-assemblies or "vehicle body width" so the vehicle, when directed through a track-switching unit, is able to fit within the horizontal gap between two rails of a same track and pass through the track-switching unit without any inadequate interferences;

wherein a third design guideline comprises:

minimizing clearance gaps above and below the rails fundamentally at the internal ends of the branch fixed-rails, and/or minimizing the top height of the wheels-assembly to the height of its top wheels, and/or minimizing the bottom height of the wheels-assembly to the height of its bottom wheels, whilst always allowing the wheels-assemblies to pass through the track-switching unit without any inadequate interferences, wherein a fourth design guideline comprises:

progressive vertical distancing/approximating of the tracks in diverging/merging points, avoiding any lateral turns of the tracks in a portion of the guideway referred as "straight-guideways segment" that is linked to the branch fixed-rails and thus is adjacent to the track-switching unit;

and wherein a fifth design guideline comprises reducing the longitudinal length of the straight-guideways segments derived from the fourth design-guideline by means of minimizing the top height of the vehicle body and/or minimizing the bottom height of the vehicle body.

In a fifteenth embodiment, a track-switching system, for use to allow coordinated and controlled selective switching of multiple track segments of a vehicle-guiding system comprises:

one or more track-switching units of claims 13 or 14, an electronic operating control system, and a supporting structure;

wherein the electronic operating control system manages the one or more track-switching units, including activating, coupling, verifying, maintaining and controlling the functioning of the track-switching units and their rail-switching units, and wherein the supporting structure solidly supports, consolidates and protects elements comprised within the track-switching system and, if appropriate, also firmly attaches them to the ground and/or to the common guideway structures or integrates them with the supporting structures of the track-switching units.

In a sixteenth embodiment, the track-switching unit can be optimally used in a two-ways horizontal-layout switching point that requires full continuity of vehicle-interacting rail surfaces without excluding existing rail-crossings, fundamentally by configuring each of the rail-switching units with a long-enough and adequately shaped outer-curve curved switch-rail with a branch end that actually surpasses the bisector plane placed between the axis of the two rail-switching units and with a solid attachment to its rotatable hub. In this embodiment, the inner-curve curved switch-rails present longitudinal dimensions significantly lower than those of the outer-curve curved switch-rails and they rotate freely without the additional support of an engagement guiding system as it is the case of the outer-curve curved switch-rails. In the referred embodiment, the shapes of the engagement guiding system of each rail-switching unit overlaps and integrates with each other to avoid potential conflicts with the rotation of the switch-rails, which of course can also only be achieved if the rotational movements of the two rail-switching units are properly synchronized. In an alternative embodiment each rail-switching unit could be provided with curved switch-rails having a same longitudinal length (but still different curvature profile) and with engagement guiding systems used simultaneously by the branch ends of both curved switch-rails.

DETAILED DESCRIPTION OF THE EMBODIMENTS

Hereafter, an embodiment of a system to switch tracks is described in detail with reference to the accompanying drawings.

Rail-Switching Unit

The herein disclosed device referred as "rail-switching unit" (RSU) allows selective switching of one rail segment of a guideway operating either singly (as in a mono-rail track-switching device) or combined with other same units (in a multi-rail track-switching device).

A rail-switching unit (RSU) is part of an ampler system that allows controlled selective switching of a track segment and is referred as a "track-switching unit" (TSU). A track-switching unit (TSU) is part of an ampler system that allows coordinated and controlled selective switching of multiple track segments and is referred as a "track-switching system" (TSS). A track-switching system (TSS) is part of an ampler system that allows guiding of vehicles along a guideway and is referred as a "vehicle-guiding system" (VGS). A vehicle-guiding system (VGS) comprises "guideways" and "vehicles".

The guideways include standard stationary rails or "common-rails" (CR) and special rail segments that are essential parts of the guideway points. These rail segments may be divided into movable ones, or "switch-rails" (SWR0/1/2/ . . . ), and stationary ones, or "fixed-rails". Fixed-rails may in turn be divided in primary rail segments, or "main fixed-rails" (MFR), and secondary branching rail segments, or "branch fixed-rails" (BFR0/1/2/ . . . ).

Figure 6A:
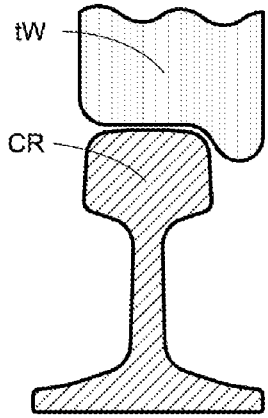
FIG. 6A PRIOR ART
FIG. 6A (PRIOR ART) is a schematic front cross-sectional view of the rail and wheel simple contact in the case of a common railway, which can be handled by conventional switching devices as well as by ones according with embodiments of the present invention.
Figure 6B:
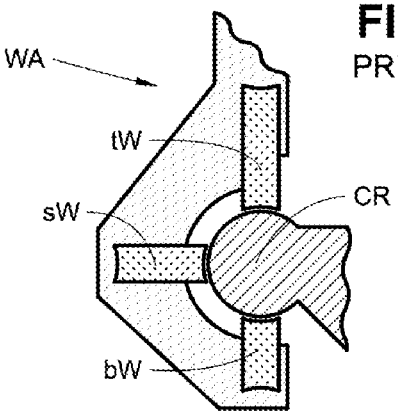
FIG. 6B PRIOR ART
FIG. 6B (PRIOR ART) is a schematic cross-sectional view of the rail and wheels-assembly wrapping contact in the case of a modem roller coaster, which can be handled by conventional switching devices as well as by ones according with embodiments of the present invention.

The vehicles, which might be trains, trolleys, pods, wagons, carriage vehicles or the like (or any physical entity containing or grouping goods or passengers to facilitate their movement along a guideway), may include different mechanisms to move along the guideways (such as those based on wheels) referred as "wheels-assemblies" (WA). These may comprise different sets of "wheels" (or similar mechanisms to facilitate minimized-friction movement of a solid movable element relative to a stationary surface). Wheels may be divided into "top wheels" (tW) or "support-wheels" (wheels that support the weight of the vehicle and normally run on top of the rails), "side wheels" (sW) or "guide wheels" (wheels that support the lateral guiding of the vehicle and normally run at one side of the rails), and "bottom wheels" (bW) or "up-stop wheels" (wheels that prevent vehicles from coming up off the track and run hugging the bottom of the rails). FIG. 6A presents a simple wheel-rail contact of a typical railway, where a top wheel (tW) supports the weight of the vehicle and moves along and on top of a common-rail (CR). In contrast, FIG. 6B presents the more complex example of a wheels-rail contact of a typical roller-coaster, where a wheels-assembly (WA) comprising three sets of wheels (tW, sW and bW) wraps around a common-rail (CR).

The rail-switching unit (RSU) comprises a rotatable set of components or "rotatable ensemble" (RE) and a stationary set of components or "stationary set" (SS). The rotatable ensemble (RE) further comprises a "rotatable hub" (RH), a set of two, three or more switch-rails (SWR0/1/2/ . . . ), a set of auxiliary components (AC1/2/3/ . . . ) to facilitate attachment of the switch-rails to the rotatable hub and/or to optimize the physical attributes of the rotatable ensemble (volume, mass, solidness, moment of inertia about the axis of rotation, etc.) and/or to facilitate precise control of the rotational movement of the rotatable ensemble. The stationary set (SS) further comprises one main fixed-rail (MFR), a set of two, three or more branch fixed-rails (BFR0/1/2/ . . . ) and a supporting structure (ST).

Figure 10B:
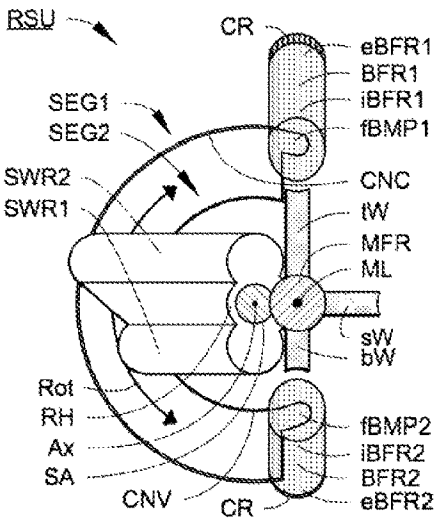
FIG. 10B is a schematic back view of a section plane (SP) of the same presented in 10A.
Figure 10A:
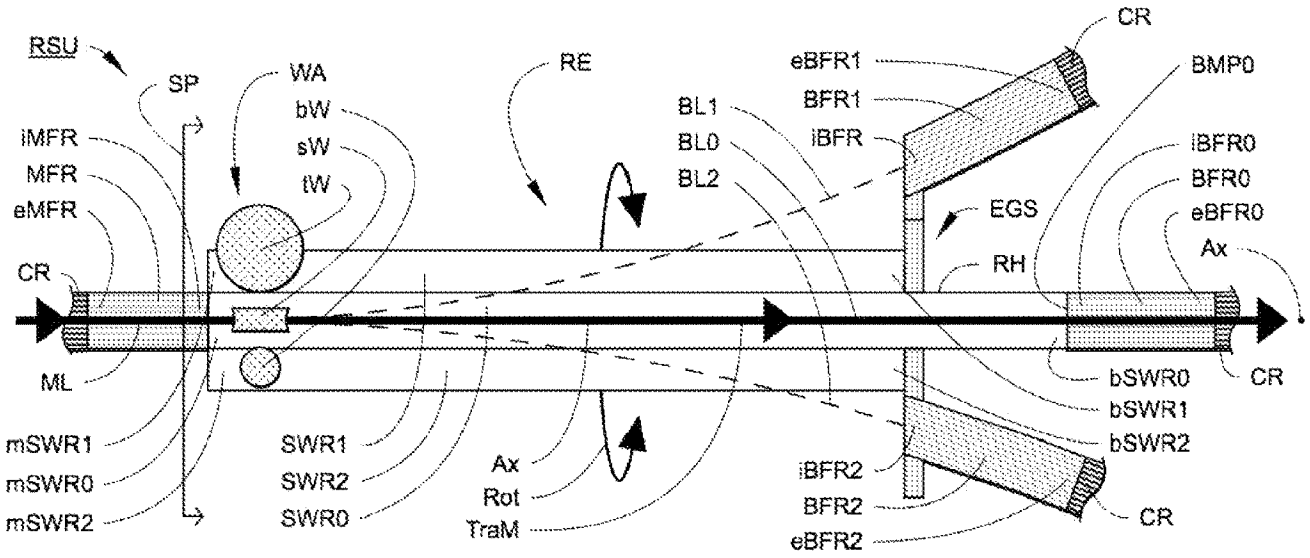
FIG. 10A is a schematic side view of a rail-switching unit configured for a left rail (of a bi-railed track) at a 3-ways vertical-layout diverge-point where a 'straight' position is activated, in a preferred embodiment of the present invention.
Figure 11B:
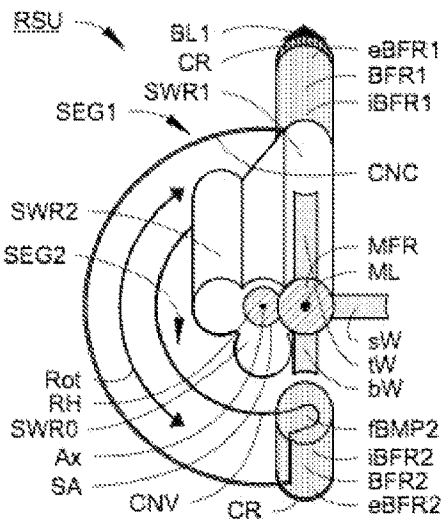
FIG. 11B is a schematic back view of a section plane (SP) of the same presented in 11A.
Figure 11A:
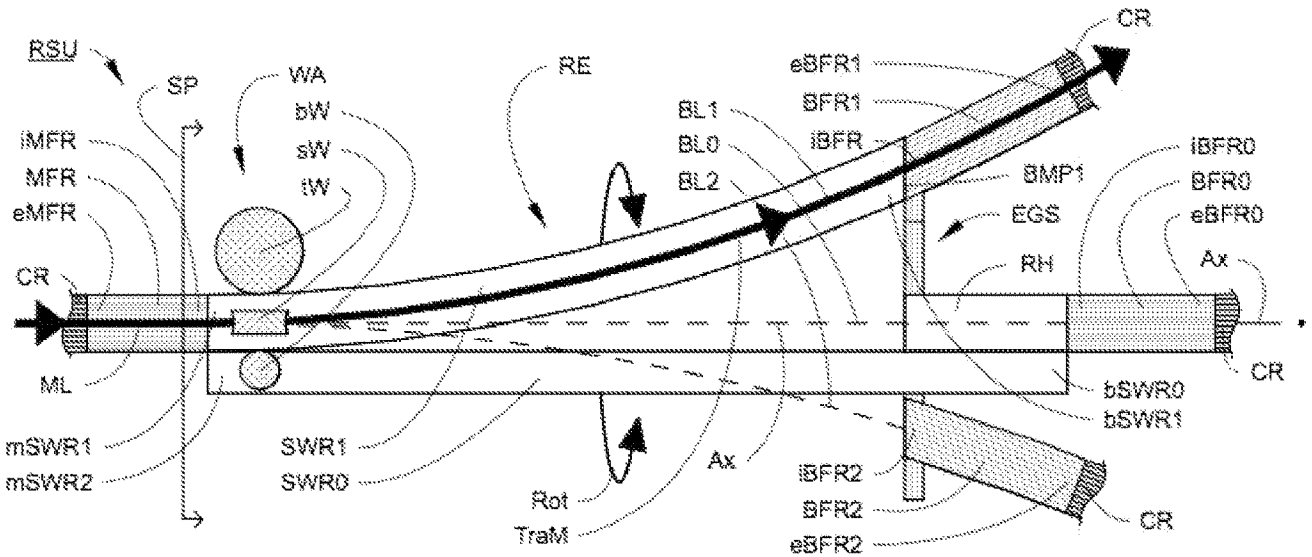
FIG. 11A is a schematic side view of the same rail-switching unit of FIG. 10A/B, but with an 'up' position activated.
Figure 12B:
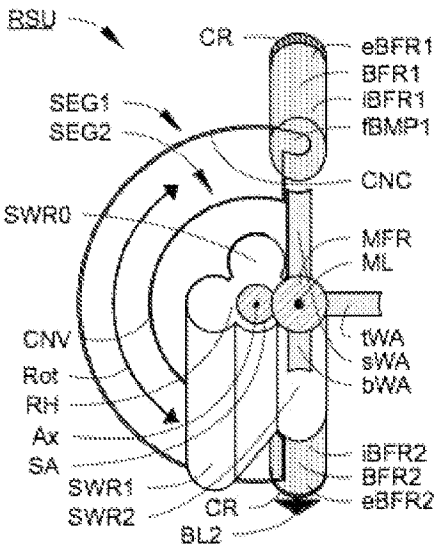
FIG. 12B is a schematic back view of a section plane (SP) of the same presented in FIG. 12A.
Figure 12A:
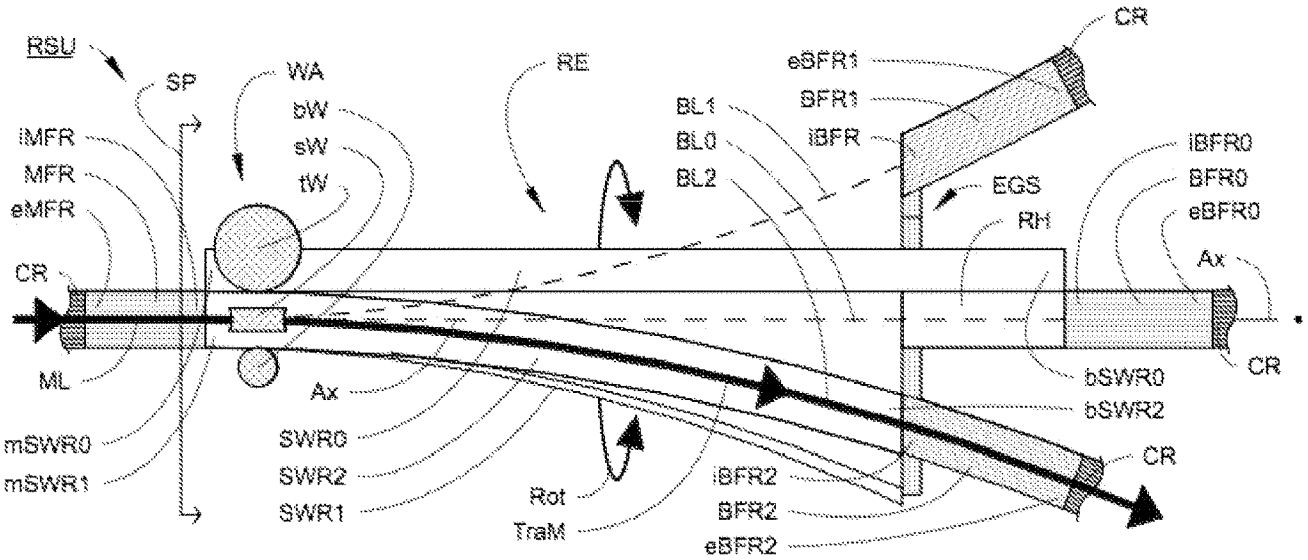
FIG. 12A is a schematic side view of the same rail-switching unit of FIGS. 10-11A/B, but with a 'down' position activated.
Figure 17A:
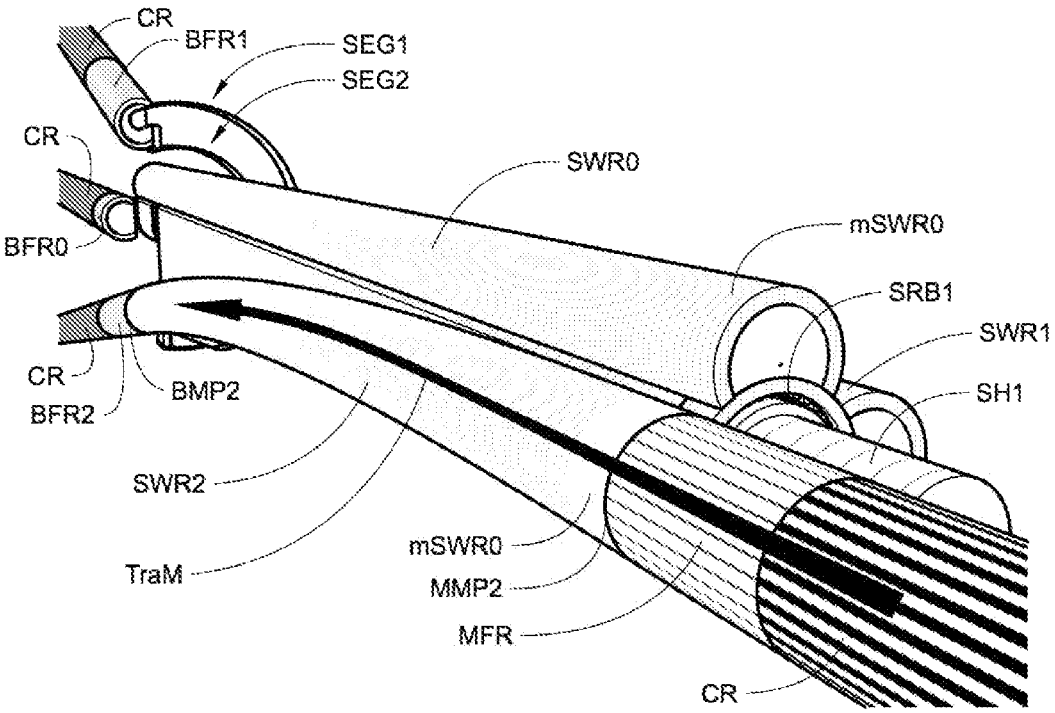
FIG. 17A is a perspective view (from the same point of view of FIGS. 15A and 16A) of the same rail-switching unit of FIGS. 15A/B and 16A/B, where all the rotatable elements of FIG. 15A/B and all the stationary elements of FIG. 16A/B are jointly presented.

Referring to FIG. 10A/B-12A/B and 13, the rail-switching unit (RSU) comprises a barrel that can rotate or "rotatable hub" (RH), a set of switch-rails (SWR0/1/2), a main fixed rail (MFR), a set of branch fixed-rails (BFR0/1/2) and a shaft arrangement (SA). In FIGS. 10A/B-12A/B, 13, 14 and 16-17A/B, a system to facilitate engagement of the switch-rails with the fixed-rail, or "engagement-guiding system" (EGS) can also be appreciated. In FIGS. 17A/B and 19, a possible actuator arrangement (AA) without structural elements can also be appreciated.

Figure 15A:
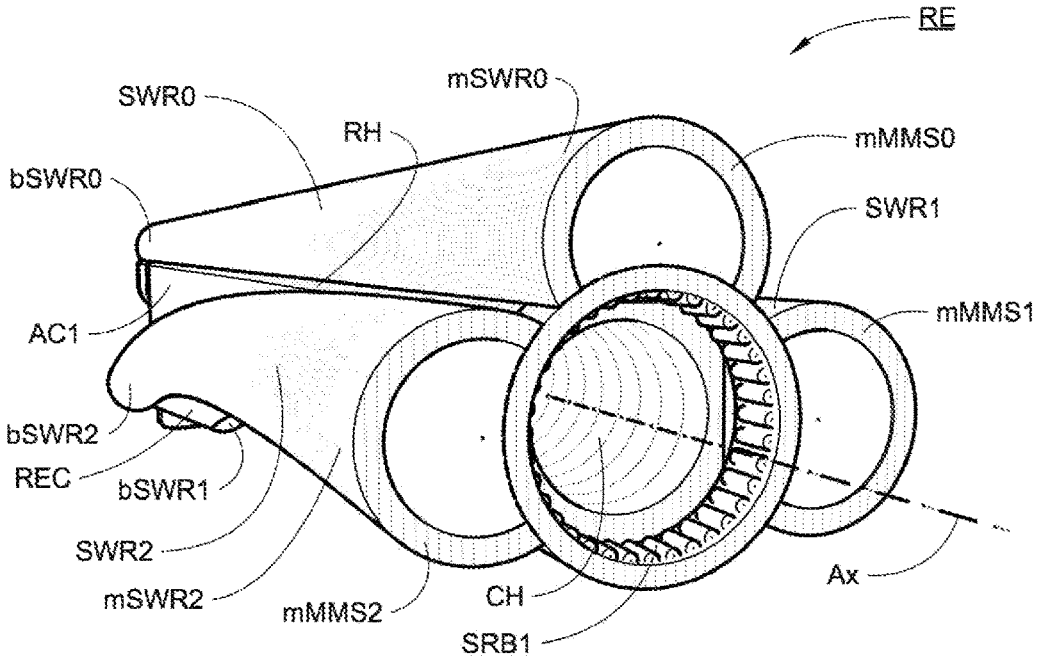
FIG. 15A is a perspective view (from the left of the front/main side) of a 3-ways vertical-layout rail-switching unit at a diverge-point configured for a right rail of a bi-railed track (not a left rail as in FIGS. 10-12A/B), where a 'down' position has been activated, in a preferred embodiment of the present invention, where only the rotatable ensemble (comprising rotatable hub, switch-rails, sets of bearings, engagement-guiding bearings, moveable guiding components and auxiliary components) is presented.
Figure 15B:
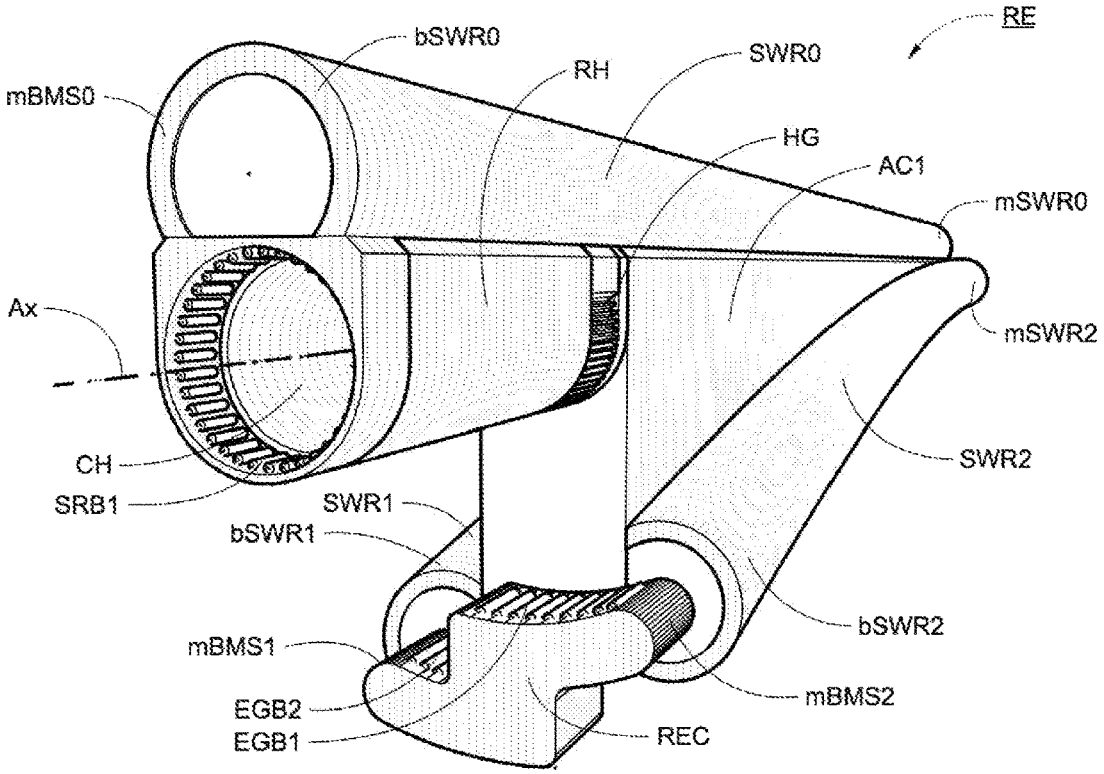
FIG. 15B is a perspective view (from the right of the back/branches side) of the same presented in FIG. 15A.
Figure 16A:
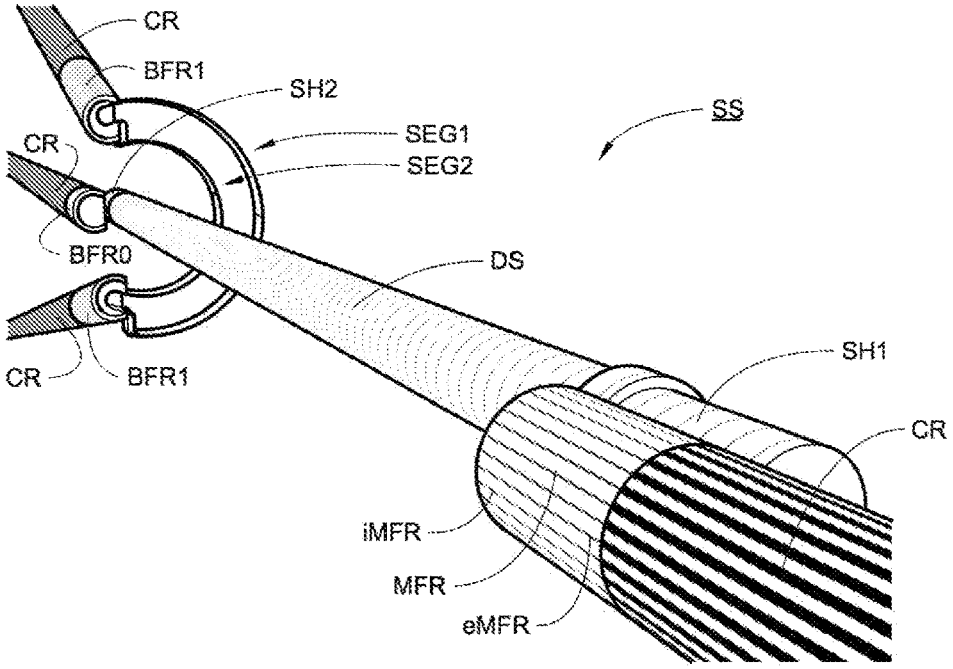
FIG. 16A is a perspective view (from the same point of view of FIG. 15A) of the same rail-switching unit of FIG. 15A/B, where only the stationary elements are presented: common-rails, fixed-rails, engagement guides and stationary shaft (not supporting structures)
Figure 18:
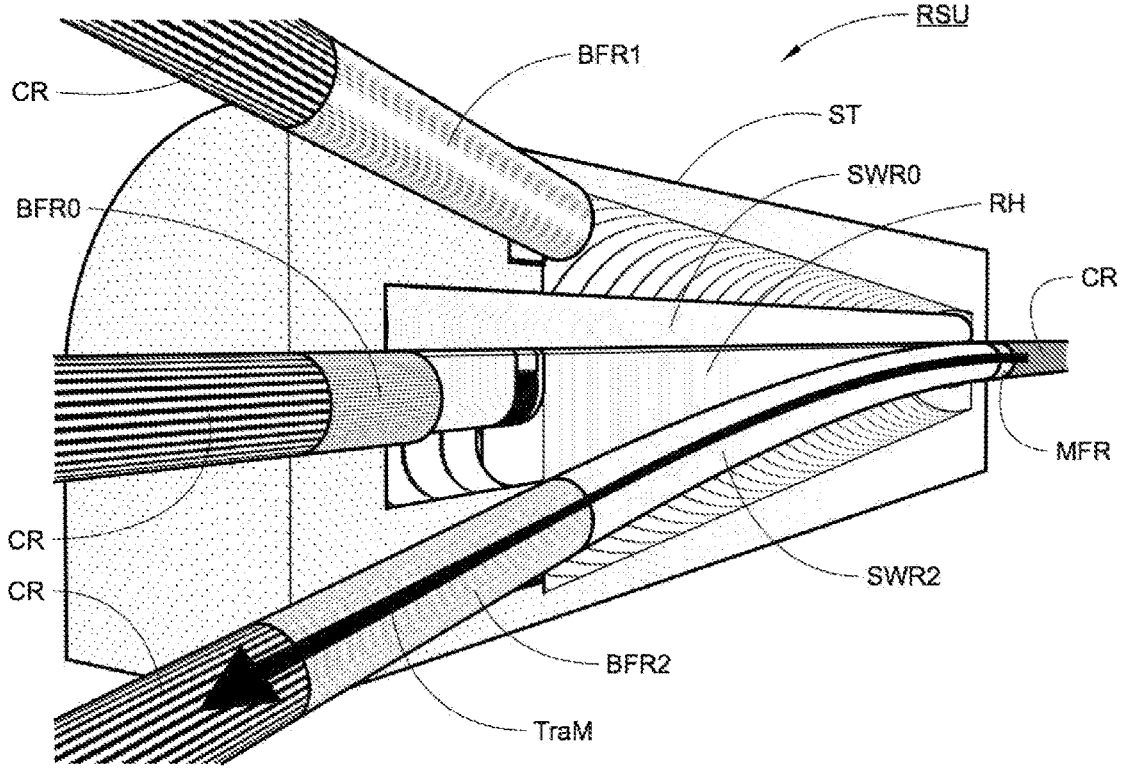
FIG. 18 is a perspective view (from the same point of view of FIGS. 15B, 16B and 17B) of the same presented in FIG. 17B, but further including a possible supporting structure.
Figure 19:
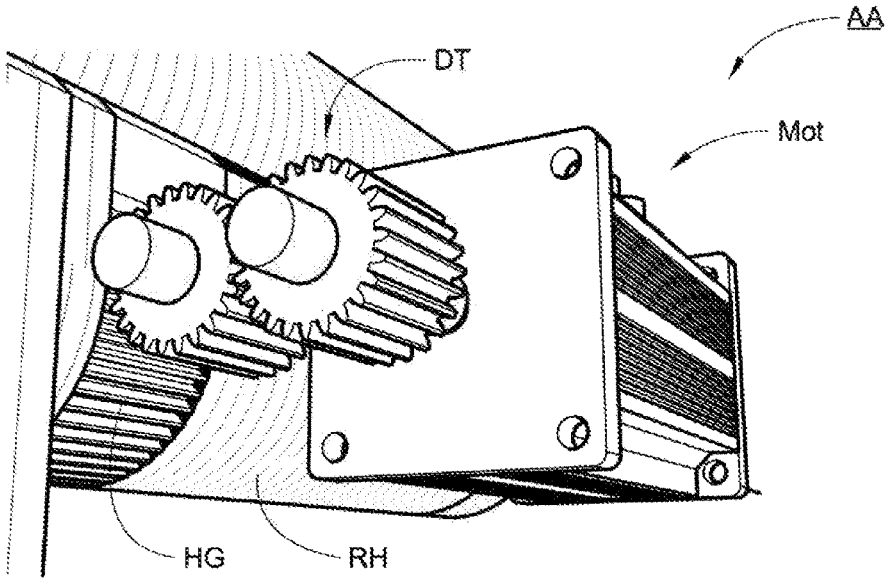
FIG. 19 is a perspective view of a possible actuator arrangement including a motor, a drive-transmission mechanism, and a partial gear integrated with the rotatable hub (and not including supporting structure elements).

FIG. 15A/B present three-dimensional perspective views of only the movable elements that are part of a rotatable ensemble (RE), whereas FIG. 16A/B show only the fundamental "fixed" elements that are part of a stationary set (SS)—excluding a structure (ST)—. FIG. 17A/B present jointly rotatable and stationary elements all together. FIG. 18 presents the same as in 17A/B but including a possible structure (ST).

Main Fixed-Rail

Referring to FIGS. 10A/B-12A/B and 13, the main fixed-rail (MFR) is represented as a simple solid straight rail segment (though it may also be hollow or with a non-straight profile). The main fixed-rail (MFR) is attached at its external end (eMFR) to a common-rail (CR) by means of a standard guideway connection, and it is installed to facilitate a precise and solid engagement of its internal end (iMFR) with a main end of the switch-rails (mSWR0/1/2) by means of mating profiles.

Figure 13:
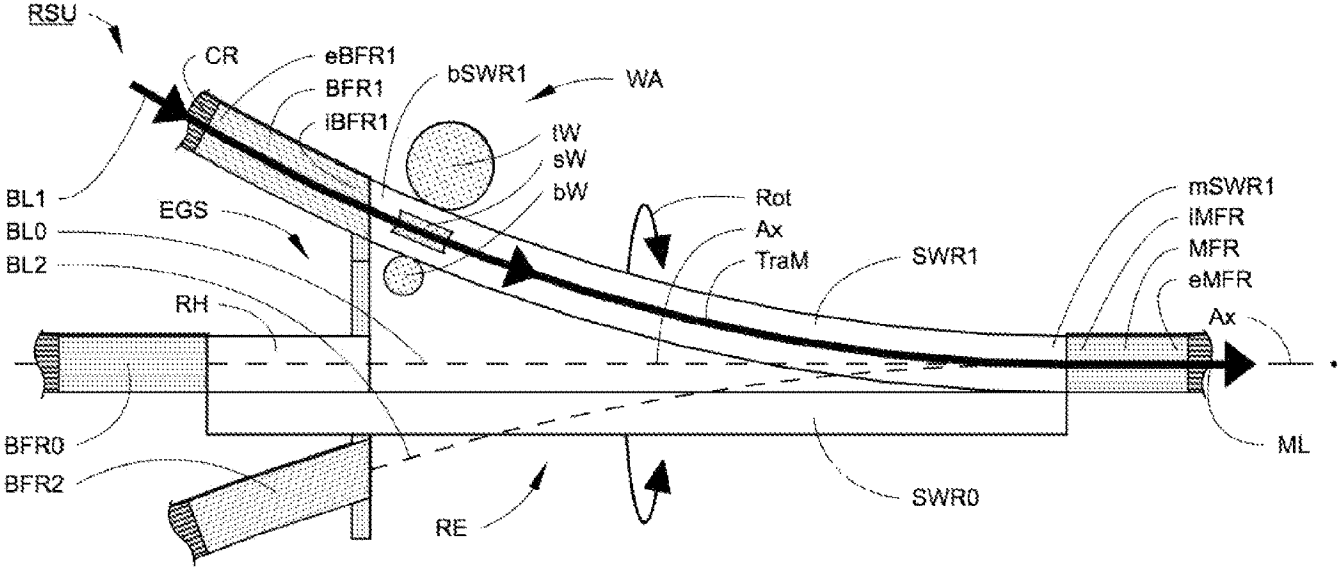
FIG. 13 is a schematic side view of a rail-switching unit configured for a left rail (of a bi-railed track) at a 3-ways vertical-layout of not a diverge-point but a merge-point, where a 'down' position is activated, in a preferred embodiment of the present invention.

In FIGS. 10A/B-12A/B, which represents a diverge-point, the main fixed-rail (MFR) is placed at the inbound side of the rail-switching unit (RSU) guiding the translational motion (TraM) of a wheels-assembly (WA) into an active switch-rail (SWR0/1/2) of the rail-switching unit (RSU). In FIG. 13, which represents not a diverge-point but a merge-point, the main fixed-rail (MFR) is placed at the outbound side of the rail-switching unit (RSU) guiding the translational motion (TraM) of a wheels-assembly (WA) out of the rail-switching unit (RSU) into a common-rail (CR).

Branch Fixed-Rails

Referring to FIGS. 10A/B-12A/B and 13, the branch fixed-rails (BFR0/1/2) are represented as simple solid rail segments, either straight (BFR0) or curved (BFR1 and BFR2) (though they may also be hollow or have other profiles). The branch fixed-rails (BFR0/1/2) are attached to a common-rail (CR) at their external ends (eBFR0/1/2) by means of a standard guideway connection, and they are installed to facilitate precise and solid engagement of their internal ends (iBFR0/1/2) with the corresponding branch ends of the switch-rails (bSWR0/1/2) by means of mating profiles (BMP0/1/2).

In FIGS. 10A/B-12A/B, which represent a diverge-point, the branch fixed-rails (BFR0/1/2) are placed at the outbound side of the rail-switching unit guiding the translational motion (TraM) of a wheels-assembly (WA) out of the rail-switching unit (RSU). In FIG. 13, which represents not a diverge-point but a merge-point, the branch fixed-rails (BFR0/1/2) are placed at the inbound side of the rail-switching unit guiding the translational motion (TraM) of a wheels-assembly (WA) into the rail-switching unit (TSU).

The set of branch fixed-rails preferably includes a combination of two or three of the following: one fixed-rail shaped and/or configured to be connected with the straight switch-rail and referred as "straight-path branch fixed-rail" (BFR0), one fixed-rail shaped and/or configured to be connected with the first curved switch-rail and referred as "first curved-path branch fixed-rail" (BFR1), one fixed-rail shaped and/or configured to be connected with the second curved switch-rail and referred as "second curved-path branch fixed-rail" (BFR2).

The straight-path branch fixed-rail (BFR0) is preferably fixed to a common-rail (CR) at its external end (eBFR0) and installed to facilitate engagement of its internal end (iBFR0) with the branch end of a corresponding straight switch-rail (bSWR0) by means of a pair of a female and male mating surfaces (fMMS0 and mMMS0).

The first curved-path branch fixed-rail (BFR1) is preferably fixed to a common-rail (CR) at its external end (eBFR1) and installed to facilitate engagement of its internal end (iBFR1) with the branch end of a corresponding first curved switch-rail (bSWR1) by means of a pair of a female and male mating surfaces (MMSf1 and MMSm1).

The second curved-path branch fixed-rail (BFR1) is preferably fixed to a common-rail (CR) at its external end (eBFR2) and installed to facilitate engagement of its internal end (iBFR2) with the branch end of a corresponding second curved switch-rail (bSWR2) by means of a pair of a female and male mating surfaces (MMSf2 and MMSm2).

Switch-Rails

Referring to FIGS. 10A/B-12A/B and 13, the switch-rails (SWR0/1/2) provide different alternatives for establishing connections between the main fixed-rail (MFR) and the branch fixed-rails (BFR0/1/2).

The set of switch-rails preferably includes the following switch-rails:

- one switch-rail with a basically straight shape and referred as "straight switch-rail" (SWR0),
- one first switch-rail with a basically curved shape and referred as "first curved switch-rail" (SWR1),
- and one second switch-rail with a basically curved shape and referred as "second curved switch-rail" (SWR2).

Straight Switch-Rail

Referring to FIGS. 10A/B, when the straight switch-rail (SWR0) is rotated into its active position, it engages simultaneously on a main end (mSWR0) with the main fixed-rail (MFR) and on a branch end (bSWR0) with a corresponding straight-path branch fixed-rail (BFR0), providing enough continuous running surface (or connection level) between the fixed-rails and the switch-rail so as to guide the translational motion (TraM) of the wheels-sets (tW, sW and bW) of a wheels-assembly (WA) from a main path-line (ML) through the rail-switching unit and into a path of an approximately-straight branch-line (BL0).

Referring to FIGS. 15A/B and 17A/B, the straight switch-rail (SWR0) is preferably configured fixed to the external face of the rotatable hub (RH) parallel to the axis of rotation (Ax) so it can be rotated into its active position to engage simultaneously on one end with the main fixed-rail (MFR) and on the other end with its corresponding branch fixed-rail (BFR0), and with a main end (mSWR0) placed in relation to the axis of rotation (Ax) at the same perpendicular distance as the main ends of the other switch-rails (mSWR1/2).

In FIG. 13, which represents not a diverge-point but a merge-point, the rail-switching unit (TSU) shows a selected 'down' position by which a first curved switch-rail (SWR1) is in its active position of engagement by connecting on one end (bSWR1) with an internal end (iBFR1) of a first curved-path branch fixed-rail (BFR1) and on the other end (mSWR1) with an internal end (iMFR) of a main fixed-rail (MFR) in order to allow directing the translational motion (TraM) of a wheels-assembly (WA) through the track-switching unit (TSU) from a first curved-path line (BL1) into a main line (ML).

First Curved Switch-Rail

Referring to FIGS. 10A/B, when the first curved switch-rail (SWR1) is rotated into its active position, it engages simultaneously on a main end (mSWR1) with the main fixed-rail (MFR) and on a branch end (bSWR1) with a corresponding first curved-path branch fixed-rail (BFR1), providing enough continuous running surface (or connection level) between the fixed-rails and the switch-rail so as to guide the translational motion (TraM) of a wheels-set (tW, sW and bW), from a main path-line (ML), through the rail-switching unit, into a path of a first approximately-curved branch-line (BL1).

Referring to FIG. 15A/B-17A/B, the first curved switch-rail (SWR1) is preferably configured fixed to the external face of the rotatable hub (RH), curving outwardly away from the axis of rotation (Ax) at its branch end, with a curved profile different from the one of the second curved switch-rail (SWR2), contained in a plane approximately parallel to the one containing the second curved switch-rail (SWR2), and with a main end (mSWR1) placed in relation to the axis of rotation (Ax) at the same perpendicular distance as the main ends of the other switch-rails and in an approximate diametrically opposite position from the main end of the second curved switch-rail (bSWR2).

Second Curved Switch-Rail

Referring to FIGS. 10A/B, when the second curved switch-rail (SWR2) is rotated into its active position, it engages simultaneously on a main end (mSWR2) with the main fixed-rail (MFR) and on a branch end (bSWR2) with a corresponding second curved-path branch fixed-rail (BFR2), providing enough continuous running surface (or connection level) between the fixed-rails and the switch-rail so as to guide the translational motion (TraM) of a wheels-set (tW, sW and bW), from a main path-line (ML), through the rail-switching unit, into a path of a second approximately-curved branch-line (BL2).

Referring to FIG. 15A/B-17A/B, the second curved switch-rail (SWR2) is preferably configured fixed to the external face of the rotatable hub (RH), curving outwardly away from the axis of rotation (Ax) at its branch end, with a curved profile different from the one of the first curved switch-rail (SWR1), contained in a plane approximately parallel to the one containing the first curved switch-rail (SWR1), and with a main end (mSWR2) placed in relation to the axis of rotation (Ax) at the same perpendicular distance as the main ends of the other switch-rails and in an approximate diametrically opposite position from the main end of the first curved switch-rail (bSWR1).

Rotatable Hub

Referring to FIGS. 10A/B-12A/B, 13 and 15A/B, the rotatable hub (RH) solidly and compactly supports and holds together the set of switch-rails (SWR0/1/2) as part of the rotatable ensemble (RE) in order to accurately rotate them and place them into their active positions of engagement by means of selective bi-directional rotational movements (Rot) about a rotation axis (Ax) that longitudinally traverses a shaft arrangement (SA).

As shown in FIGS. 15A/B-17A/B and 19, the rotatable hub (RH) is preferably configured with a cylindrical hole (CH) along its axis of rotation (Ax) that integrates with an arrangement comprising a stationary shaft or "dead shaft" (DS). It is also preferably configured to receive the necessary drive force for its rotational movement (Rot) interacting with the motor (Mot) of an actuator arrangement either directly or by means of gear and pinion mechanism or "drive transmission" (DT) that may link with a gear or part of a gear is attached or carved at the external surface of the rotatable hub or "hub gear" (HG). The rotatable hub (RH) is also preferably mounted for bi-directional rotation (Rot) about a stationary axis (Ax) along the dead shaft (DS) that is placed parallel to the direction of the internal end of the main fixed-rail (MFR) and located at approximately the same height (case of vertical-layout track-switching applications, as shown in FIG. 15A/B) or beneath it (case of horizontal-layout track-switching applications such as that of FIG. 5).

Differential Physical Dynamic of the Rotatable Ensemble

Figure 20:
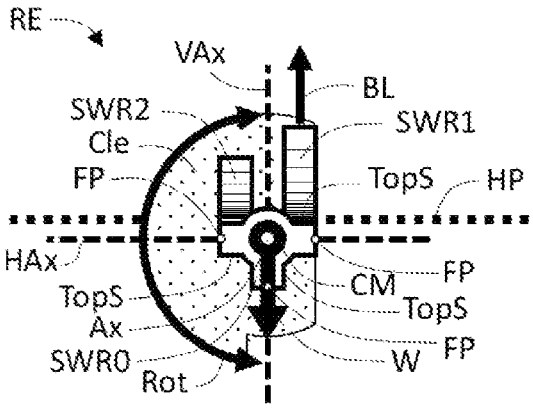
FIG. 20 is a schematic cross-section view of only the rotatable ensemble of a rail-switching unit configured for a left rail of a bi-railed track at a 3-ways (upwards, straight forward and downwards) vertical-layout diverge-point where an 'upwards' position is activated, with curved switch-rails of different curvature profiles, in a preferred embodiment of the present invention.
Figure 21:
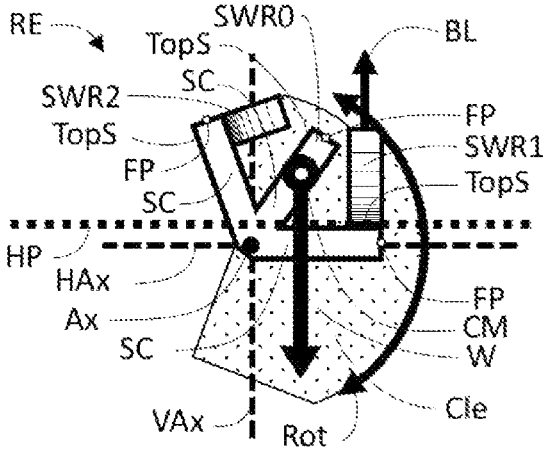
FIG. 21 PRIOR ART
FIG. 21 (PRIOR ART) is a schematic cross-section view of the rotatable ensemble of a known monorail-switching unit configured for a 3-ways vertical-layout diverge-point, where an 'upwards' position is activated and where the switching problem to resolve and the vehicle-interacting surfaces of the switch-rails are of the same shape and size as those of FIG. 22.

Referring to FIGS. 20-21, both of them present a same cross-section view of a same 3-ways vertical-layout diverging switch-point problem to switch and connect a set of three switch-rails with same vehicle-interacting surfaces; however, the two figures provide quite different solutions: FIG. 20 shows the rotatable ensemble (RE) of the rail-switching unit (RSU) according to a preferred embodiment, and FIG. 21 shows a rotatable ensemble (RE) of a monorail-switching assembly according to prior-art patent GB 1,404,648. Both solutions exemplified in FIGS. 20-21 present rotatable ensembles (RE) of devices configured to connect the left rail of a main bi-railed track section (not shown) with the left rail of one of three branch bi-railed track sections (also not shown): one that keeps heading straight, one that diverges vertically upwards, and one that diverges vertically downwards. Both figures present a rotatable ensemble (RE) that can rotate about an axis of rotation (Ax) generating a rotational movement (Rot) of a set of switch-rails comprising one straight switch-rail (SWR0), one upwards-curve-path curved switch-rail (SWR1), and one downwards-curve-path curved switch-rail (SWR2), all of them with rectangular cross-section rail profiles with vehicle-interacting surfaces placed at their top side and at their inside-of-track lateral side; the upwards-curve-path curved switch-rail (SWR1) is shown placed in its active engagement position, hence providing continuous rail-connection following a vertically upwards-diverging branch rail path line (BL). Both figures also present the vertical (VAx) and horizontal (HAx) planes that define the axis of rotation (Ax), as well as the horizontal plane (HP) containing the main-end highest point of the top vehicle-interacting surface (TopS) of the switch-rails when engaged in their active position.

The vehicle-interacting surfaces of a rail are defined as those external surfaces of the rail that are susceptible of interacting with rail-interacting components of passing vehicles (such as wheels-assemblies). The top vehicle-interacting surface (TopS) of a rail section is defined as the vehicle-interacting surface placed at the top of the rail. FIGS. 20-21 also differentially indicate the main-end furthest points of the switch-rails (FP) of each of the switch-rails (SWR0/1/2), being said furthest points (FP) of a switch-rail (SWR0/1/2) defined as the point of the external surface of said switch-rail that is located furthest from the axis of rotation (Ax) and that is included within the cross-section at the main-end of the rotary ensemble (RE).

Differences between the solution of FIG. 20 and the one of FIG. 21 are as follows:

- In FIG. 20 planes containing the curved rail path lines of the curved switch-rails SWR1 and SWR2 are parallel to each other and to the axis of rotation (Ax), thus never crossing it, whereas in FIG. 21 said same equivalent planes are far from parallel to each other and to the axis of rotation axis (Ax), thus crossing it, being angularly displaced from each other an angle not exceeding 110°.
- In FIG. 20 the center of mass of the straight switch-rail (SWR0) and the center of mass of the grouped pair of curved switch-rails (SWR1-2) are placed at opposed sides from the axis of rotation (Ax), whereas in FIG. 21 they are placed at the same side of the said axis, being all three switch-rails confined within a 1100 angular scope.
- In FIG. 20 the pivotal rotational movement (Rot) of the rotatable ensemble (RE) takes place below its axis of rotation (Ax) and ranges within a 180° angular scope, whereas in FIG. 21 it takes place above the axis of rotation (Ax) and ranges within a 110° angular scope.
- In FIG. 20 main-end furthest points of the switch-rails (FP) of each of the switch-rails (SWR0/1/2) are equidistantly offset from the axis of rotation (Ax) at a minimal distance not exceeding 4 times the widest of the main-end widths of said switch-rails, whereas in FIG. 21 the equivalent ratio is approximately 6 times. Definition of main-end width of a switch-rail will be further clarified in FIGS. 27-30.
- In FIG. 20 due to the compact configuration the rotatable ensemble (RE) the supporting components of the switch-rails (not shown) are minimal, whereas in FIG. 21 the equivalent supporting components (SC) are of significant length, this implying an expected much lower weight (W) of the rotatable ensemble (RE) of FIG. 20 as compared to that of FIG. 21.
- In FIG. 20, due to the compactness and balanced distribution of the masses of the switch-rails (SWR0/1/2), center of mass (CM) of the rotatable ensemble (RE) is presumed to have been easily aligned with its axis of rotation (Ax), whereas with the rotatable ensemble (RE) of FIG. 21 this could not have been the case due its long supporting components (SC) and unbalanced distribution of the masses of its switch-rails (SWR0/1/2); hence in FIG. 20 the axis of rotation and principal axis of moment of inertia of the rotatable ensemble (RE) are aligned, whereas in FIG. 20 they are clearly not.
- In FIG. 20 the sectional area of volumetric clearance (Cle) required by the rotational movement (Rot) of the rotatable ensemble (RE) is much smaller in size than that of FIG. 21 and, contrary to that of FIG. 21, it does not include a significant space located at the right of the branch path line (BL), which could be cause of serious conflict with the body of passing vehicles. The sectional area of volumetric clearance (Cle) is depicted in the figure with a dotted surface.

Figure 22:
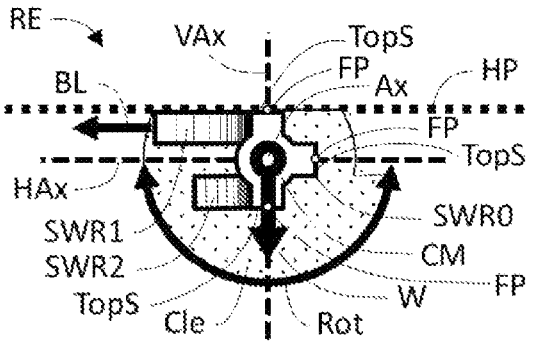
FIG. 22 is a schematic cross-section view of only the rotatable ensemble of a rail-switching unit configured for a left rail of a bi-railed track (thus having curved switch-rails with different curvature profiles) at a 3-ways (leftwards, straight and rightwards) horizontal-layout diverge-point where a 'leftwards' position is activated, in a preferred embodiment of the present invention.
Figure 23:
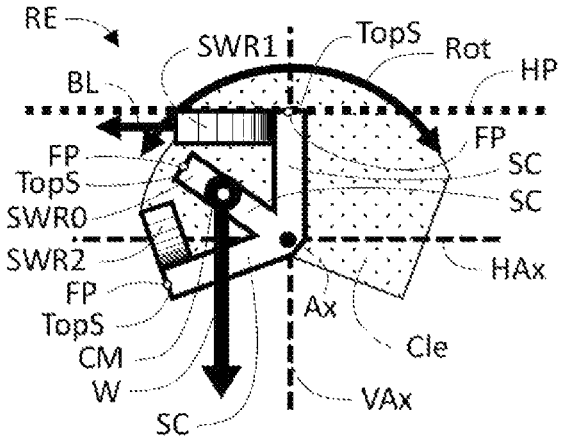
FIG. 23 PRIOR ART
FIG. 23 (PRIOR ART) is a schematic cross-section view of the rotatable ensemble of a known monorail-switching unit also configured for a 3-ways horizontal-layout diverge-point, where a 'leftwards' position is activated and where the switching problem to resolve and the vehicle-interacting surfaces of the switch-rails are of the same shape and size as those of FIG. 20.

Referring to FIGS. 22-23, FIG. 22 presents a similar rail switching unit (RSU) as that of FIG. 20, and FIG. 23 presents a similar prior-art monorail-switching assembly as that of FIG. 21, but both of them now applied to a 3-ways switch-point with a horizontal layout. Both solutions present rotatable ensembles (RE) configured to connect the left rail of a main bi-railed track section (not shown) with the left rail of one of three branch bi-railed track sections (also not shown): one that keeps heading straight, one that diverges horizontally to the left, and one that diverges horizontally to the right. Each figure presents a rotatable ensemble (RE) that can rotate about an axis of rotation (Ax) generating a rotational movement (Rot) of a set of switch-rails comprising one straight switch-rail (SWR0), one leftwards-curve-path curved switch-rail (SWR1), and one rightwards-curve-path curved switch-rail (SWR2), all of them with rectangular cross-section rail profiles; the leftwards-curve-path curved switch-rail (SWR1) is shown placed in its active engagement position, hence providing continuous rail-connection into a horizontally leftwards-diverging branch path line (BL). Both figures also present the vertical (VAx) and horizontal (HAx) planes that define the axis of rotation (Ax), as well as the horizontal plane (HP) containing the main-end highest point of the top vehicle-interacting surface (TopS) of the switch-rails when engaged in their active position. Both figures also present the main-end furthest points of the switch-rails (FP) of each of the switch-rails (SWR0/1/2), as previously defined.

Differences between the solution of FIG. 22 and the one of FIG. 23 are as follows:

In FIG. 22 planes containing the curved rail paths of the top vehicle-interacting surfaces (TopS) of the curved switch-rails SWR1 and SWR2 are parallel to each other and to the axis of rotation (Ax), thus never crossing it, whereas in FIG. 23 said same equivalent planes are far from parallel to each other and to the axis of rotation axis (Ax), thus crossing it, being angularly displaced from each other an angle not exceeding 110°.

In FIG. 22 the center of mass of the straight switch-rail (SWR0) and the center of mass of the grouped pair of curved switch-rails (SWR1-2) are placed at opposed sides from the axis of rotation (Ax), whereas in FIG. 23 they are placed at the same side of the said axis, being all three switch-rails confined within a 110° angular scope.

In FIG. 22 the pivotal rotational movement (Rot) of the rotatable ensemble (RE) takes place below its axis of rotation (Ax) and ranges within a 180° angular scope, whereas in FIG. 23 it takes place above the axis of rotation (Ax) and ranges within a 110° angular scope.

In FIG. 22 main-end furthest points of the switch-rails (FP) of each of the switch-rails (SWR0/1/2) are equidistantly offset from the axis of rotation (Ax) at a minimal distance not exceeding 4 times the widest of the main-end widths of said switch-rails, whereas in FIG. 23 the equivalent ratio is approximately 6 times. Definition of main-end width of a switch-rail will be further clarified in FIGS. 27-30.

In FIG. 22 due to the compact configuration the rotatable ensemble (RE) the supporting components of the switch-rails (not shown) are minimal, whereas in FIG. 23 the equivalent supporting components (SC) are of significant length, this implying an expected much lower weight (W) of the rotatable ensemble (RE) of FIG. 22 as compared to that of FIG. 23.

In FIG. 22, due to the compactness and balanced distribution of the masses of the switch-rails (SWR0/1/2), center of mass (CM) of the rotatable ensemble (RE) is presumed to have been easily aligned with its axis of rotation (Ax), whereas with the rotatable ensemble (RE) of FIG. 23 this could not have been the case due its long supporting components (SC) and unbalanced distribution of the masses of its switch-rails (SWR0/1/2); hence in FIG. 22 the axis of rotation and principal axis of moment of inertia of the rotatable ensemble (RE) are aligned, whereas in FIG. 23 they are clearly not.

In FIG. 22 the sectional area of volumetric clearance (Cle) required by the rotational movement (Rot) of the rotatable ensemble (RE) is much smaller in size than that of FIG. 23 and, contrary to that of FIG. 23, it does not include a significant space located at the right of the branch path line (BL), which could be cause of serious conflict with the body of passing vehicles. The sectional area of volumetric clearance (Cle) is depicted in the figure with a dotted surface.

As consequence of all the above, it can be implied that, not only in vertical-layout switch-point applications but also in horizontal-layout ones, the technical characteristics of the rail-switching unit (RSU) of FIGS. 20 and 22 are not only significantly different, but also significantly better than those of the prior-art monorail-switching assembly of respectively-compared FIGS. 21 and 23, being the main differential characteristics and advantages as follows:

lower size, weight and required radial reach of clearance (Cle) of the rotatable ensemble (RE);

significantly better-balanced distribution of switch-rails masses relative to the axis of rotation (Ax) and significantly nearer location of said masses to the said axis;

significantly lower moment of inertia relative to the axis of rotation and significantly better alignment of the axis of rotation with the principal axis of moment of inertia;

resulting lower costs of construction, transportation, installation, balancing, operation and control of the device, as well as lower risks of failure or mechanical hazards;

and resulting necessary forces to drive the device of minimal magnitude and minimal variability therefore also maximizing energy-efficiency, precision and ease of control of the device.

Figure 27:
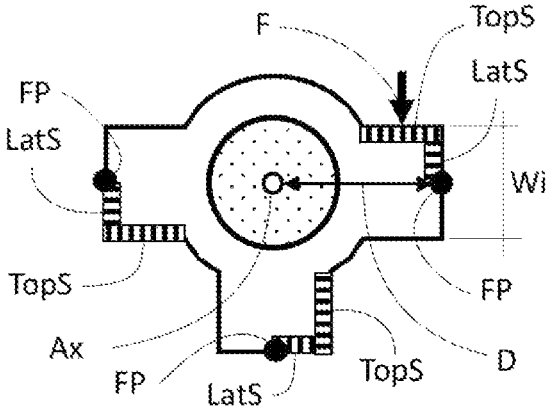
FIG. 27 is a schematic cross-section view of only the main section of the same rotatable ensemble for a 3-ways represented in FIG. 20.
Figure 28:
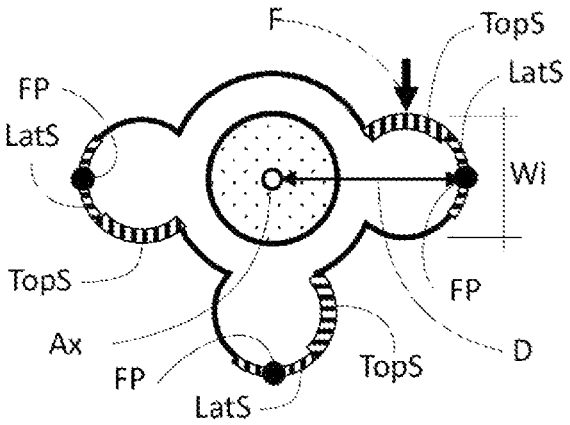
FIG. 28 is a schematic cross-section view of an equivalent rotary ensemble as that of FIG. 27 but where sections of switch-rails do not have rectangular-like profiles but round ones.
Figure 29:
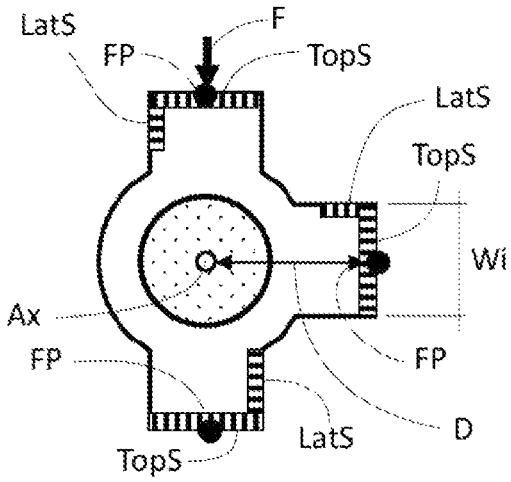
FIG. 29 is a schematic cross-section view of only the main section of the same rotatable ensemble of FIG. 22.

Referring to FIGS. 27-30, a clearer representation of the compactness of the rotatable ensemble (RE) is illustrated. FIG. 27 shows a cross-section view at the main end of a rotary ensemble (RE) with rectangular-section profiled switch-rails (SWR0/1/2) configured for a 3-ways vertical-layout switch-point. FIG. 28 also shows a cross-section view at the main-end, but of a rotary ensemble (RE) with circular-section profiled switch-rails (SWR0/1/2) in a 3-ways vertical-layout switch-point. FIG. 29 also shows a cross-section view at the main end, but of a rotary ensemble (RE) with rectangular-section profiled switch-rails (SWR0/1/2) in a 3-ways horizontal-layout switch-point.

Figure 30:
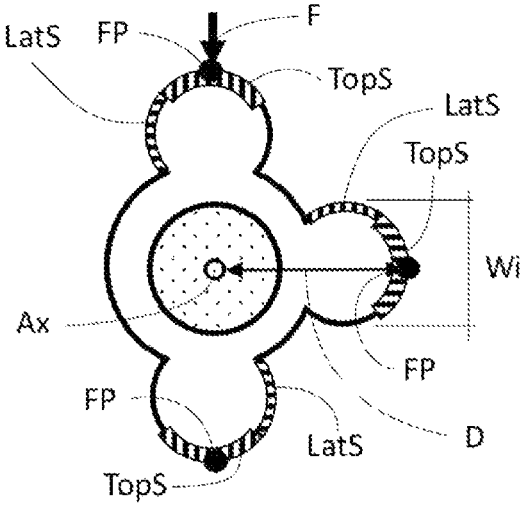
FIG. 30 is a schematic cross-section view of an equivalent rotary ensemble as that of FIG. 30 but where sections of switch-rails do not have rectangular-like profiles but round ones.

And FIG. 30 also shows a cross-section view at the main end, but of a rotary ensemble (RE) with circular-section profiled switch-rails (SWR0/1/2) in a 3-ways horizontal-layout switch-point.

In each of FIGS. 27-30, for each switch-rail (SWR0/1/2), a top vertical-interacting surface (TopS), a lateral vertical-interacting surface (LatS) and a main-end furthest point (FP) is identified. A weight-of-vehicle force (F) perpendicular to a top vehicle-interacting surface (TopS) of the rail-switch in active position is also drawn in each figure. All referred figures also illustrate how each main-end furthest point (FP) of each switch-rails (SWR0/1/2) is offset a same distance (D) from the axis of rotation (Ax). In each of the referred figures, in order to assure the compactness of the whole represented rotary ensemble (RE), distance (D) is set relative to the widest main-end width (Wi) of the switch-rails (SWR0/1/2) in a ratio preferred to be in the range of two or three times said width (Wi) and never exceeding four times. Main-end width of a switch-rail (Wi) is defined as the greatest width of its cross-section measured at the main end of the switch-rail (mSWR0/1/2) and perpendicularly to a virtual straight line joining its main-end furthest point (FP) with the rotation axis (Ax) and considering said cross-section of the switch-rail without rotary-hub supporting bodies, this is, that of minimal necessary area to hold the vertical-interacting surfaces of the switch-rail.

Figure 3:
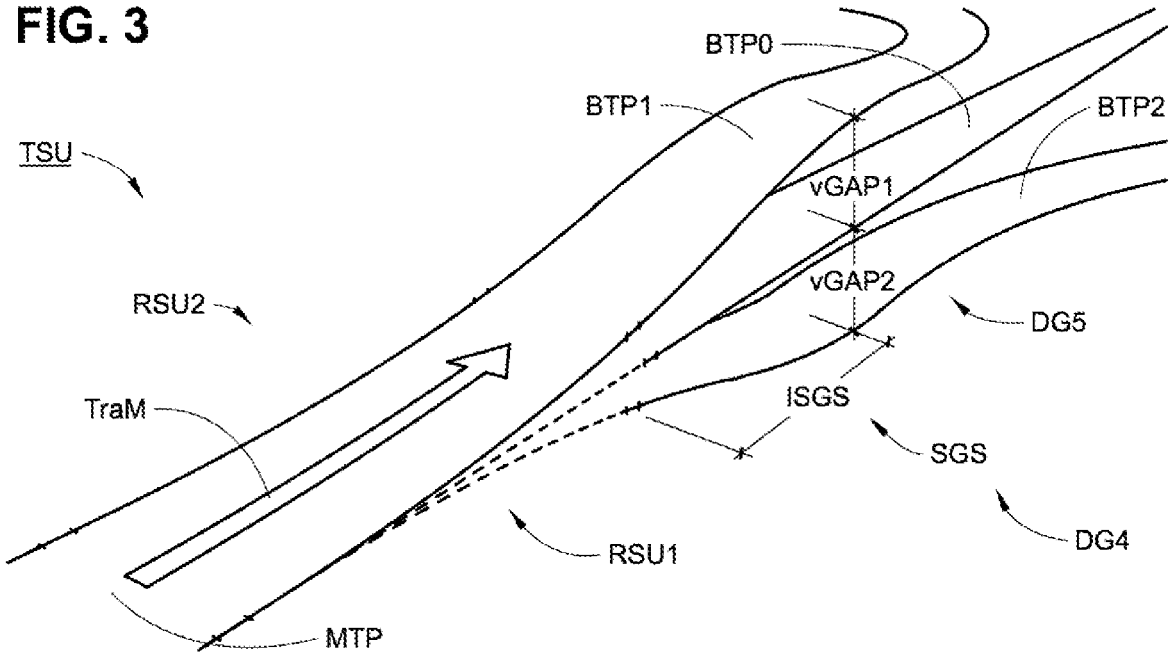
FIG. 3 is a basic schematic perspective view of the case of a vertical-layout three-diverging-ways track-switching problem, solved with a track-switching unit in accordance with a preferred embodiment of the invention.
Figure 4:
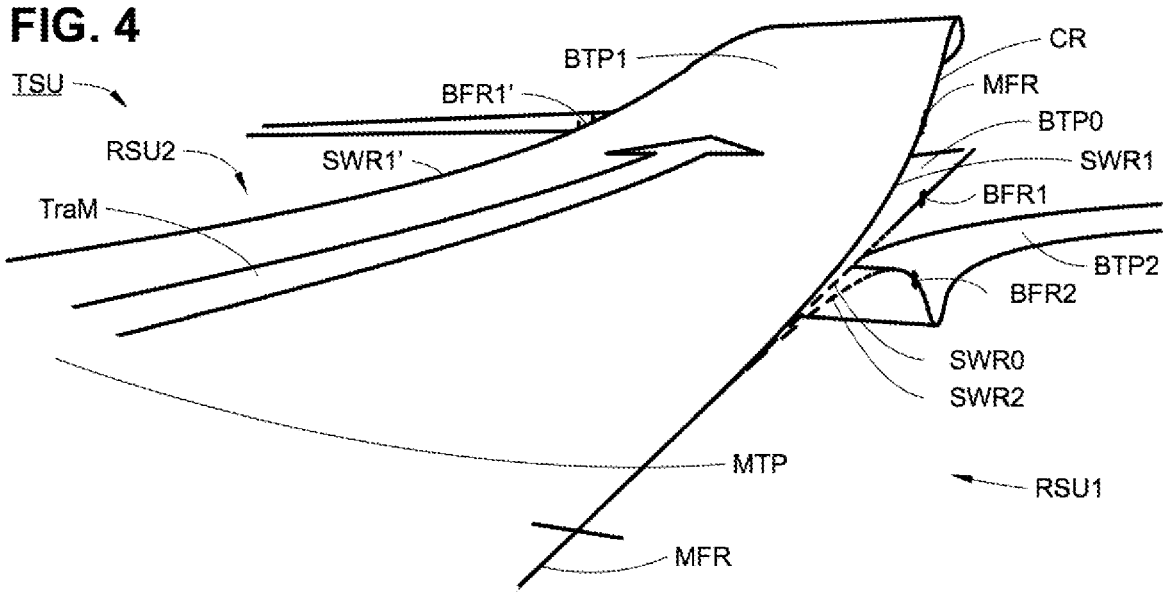
FIG. 4 is another (enlarged) basic schematic perspective view of the same shown in FIG. 3.

Vertical/horizontal layout 2 or 3-ways switch-points and rail-crossings FIGS. 3-4 and 10A/B-20 refer to switch-points on a vertical layout, where track path-lines diverge or converge in the vertical dimension. In contrast, FIGS. 22-26A/B refer to switch-points on a horizontal layout, where track path-lines diverge or converge in the horizontal dimension.

Figure 24A:
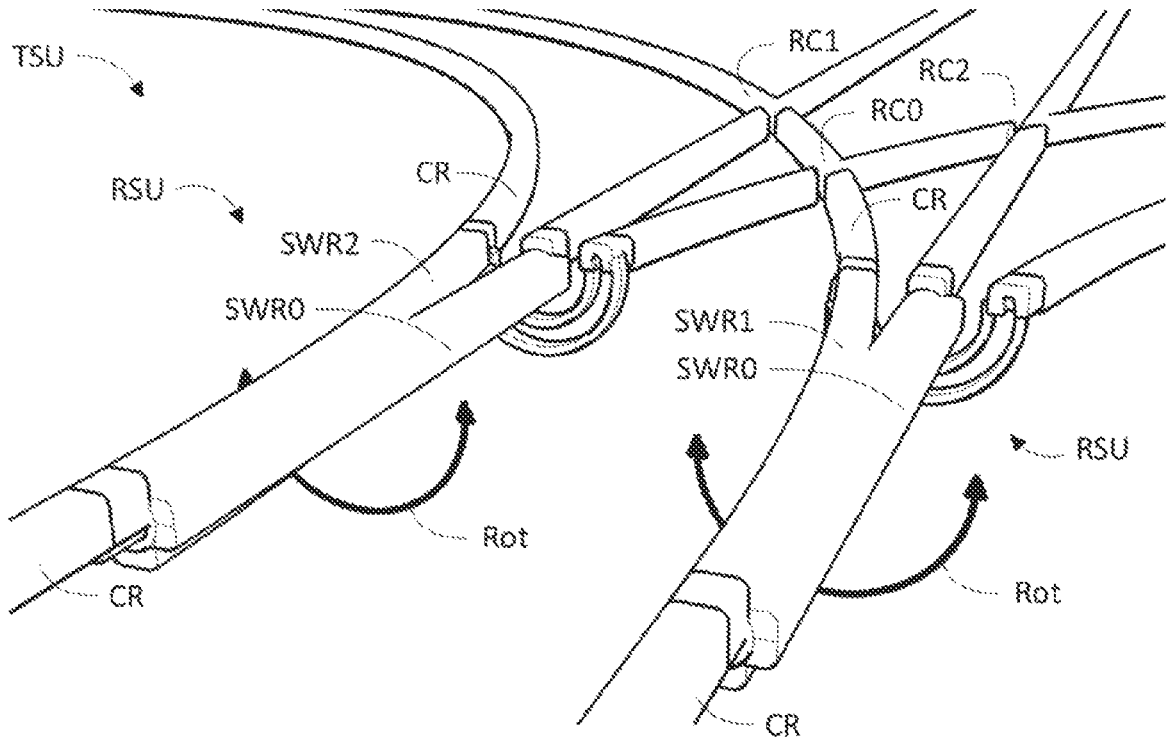
FIG. 24A is a simplified perspective view (from the right of the front/main side) of a track-switching unit with two (left and right) rail-switching units, configured for a 3-ways (leftwards, straight forward and rightwards) horizontal-layout diverge-point, where a 'leftwards' position has been activated, where rails have rectangular sections and where crossings of rails are resolved outside of the track switching unit, in a preferred embodiment of the present invention.

Referring to FIG. 24A, it shows a simplified perspective view (from the right of the front/main side) of a bi-railed track-switching unit (TSU) with two (left and right) rail-switching units (RSU), configured for a 3-ways (leftwards, straight forward and rightwards) horizontal-layout diverge-point, where a 'leftwards' position has been activated via the rotational movement (Rot), at each rail-switching unit (RSU), of one of the two curved switch-rails (SWR1, SWR2) of each rail-switching unit (RSU) into its active engagement position to provide continuous rail vehicle-interacting surfaces, in this case top and inner-lateral, joining the common rails (CR) placed before and after the track-switching unit (TSU). To activate the 'leftwards' position of the bi-railed track, the left rail-switching unit (RSU) has rotated its higher-curvature inner-curve curved switch-rail (SWR2) into its active engagement position, and the right rail-switching unit (RSU) has rotated its lower-curvature outer-curve curved switch-rail (SWR1) into its active engagement position. The higher-curvature inner-curve curved switch-rail (SWR2) of the right rail-switching unit (RSU) and the lower-curvature outer-curve curved switch-rail (SWR1) of the left rail-switching unit (RSU) are not shown simply because they remain hidden given the rotating positions illustrated in the figure.

One of the particularities of horizontal-layout switch-points is that, if they switch tracks that are not mono-railed, but bi-railed, rail-crossings are present. This is clearly shown in FIG. 24A, where 3 rail-crossings are present: one (RC0) between the outer-curve common rail of the leftwards track and the outer-curve common rail of the rightwards track, another one (RC1) between the left common rail of the straight forward track and the outer-curve common rail of the rightwards track, and another one (RC2) between the right common rail of the straight forward track and the outer-curve common rail of the rightwards track. In the referred figure, the rail-crossings (RC0, RC1 and RC2) are outside of the functional reach of the track-switching unit (TSU) as they are resolved with a common rail crossing solution wherein a minimal but sufficient gap is provided for the flange of the railway vehicle to pass through. In the specific case of 3-ways horizontal-layout switch-point applications requiring perfect rail continuity also at rail-crossings, the track-switching unit (TSU) of the present invention would not be a solution unless combined with other rail-crossing solutions, or unless strict horizontal-layout at the switch-point were not to be necessary and then a vertical-layout configured track-switching until (TSU) could be used to provide perfect rail continuity as, thanks to the vertical-layout-configuration, rail-crossings would be avoided.

Figure 24B:
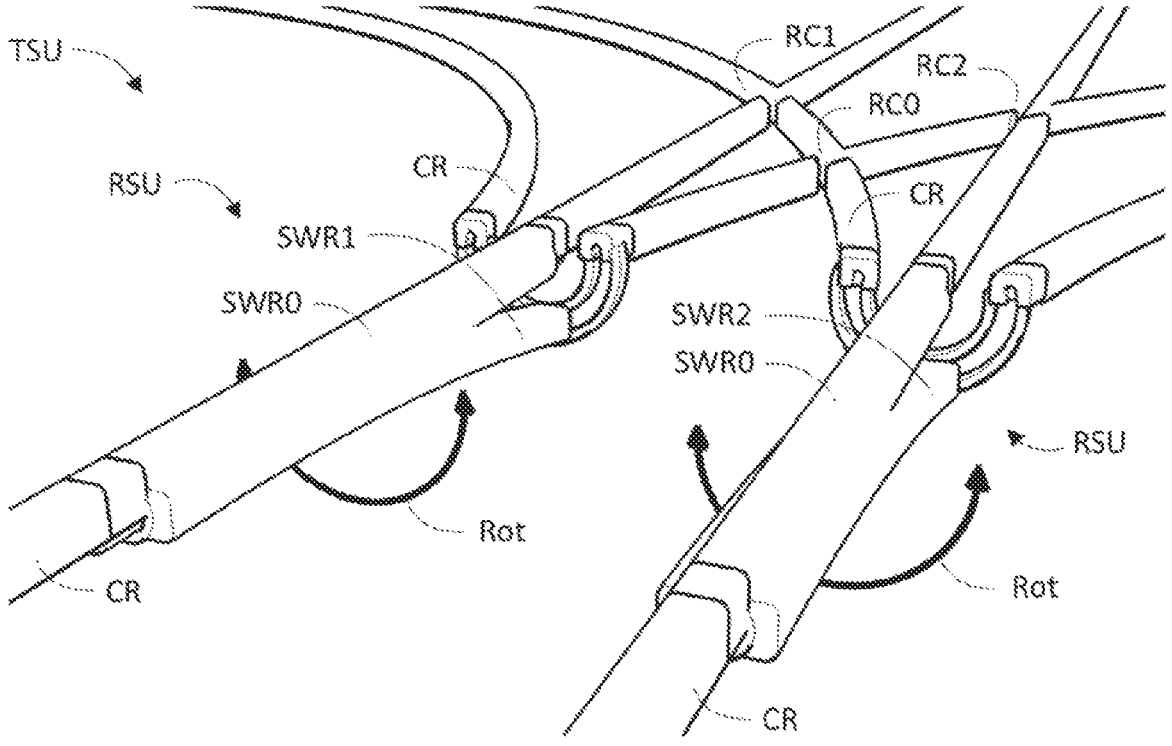
FIG. 24B is the same view of the same track-switching unit of FIG. 24A, but with a 'straight forward' position activated.

Referring to FIG. 24B, it presents the same view of the same track-switching unit of FIG. 24A, but with a 'straight forward' position activated via the rotational movement (Rot), at each rail-switching unit (RSU), of the straight switch-rail (SWR0) of each rail-switching unit (RSU) into its active engagement position to provide continuous rail vehicle-interacting surfaces, in this case top and inner-lateral, joining the common rails (CR) placed before and after the track-switching unit (TSU).

Figure 24C:
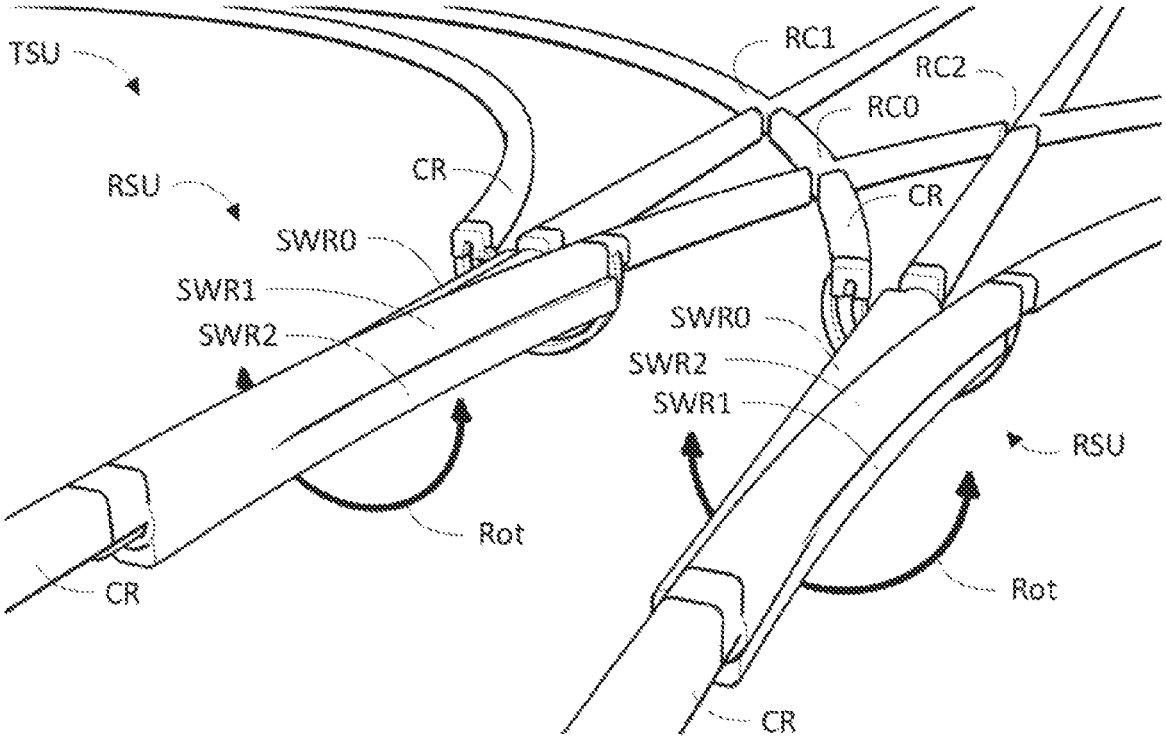
FIG. 24C is the same view of the same track-switching unit of FIG. 24A and FIG. 24B, but with a 'rightwards' position activated.

Referring to FIG. 24C, it presents the same view of the same track-switching unit of FIGS. 24A-B, but with a 'rightwards' position activated via the rotational movement (Rot), at each rail-switching unit (RSU), of one of the two curved switch-rails (SWR1, SWR2) of each rail-switching unit (RSU) into its active engagement position to provide continuous rail vehicle-interacting surfaces, in this case top and inner-lateral, joining the common rails (CR) placed before and after the track-switching unit (TSU). To activate the 'rightwards' position of the bi-railed track, the left rail-switching unit (RSU) has rotated its lower-curvature outer-curve curved switch-rail (SWR1) into its active engagement position, and the right rail-switching unit (RSU) has rotated its higher-curvature inner-curve curved switch-rail (SWR2) into its active engagement position.

Figure 25A:
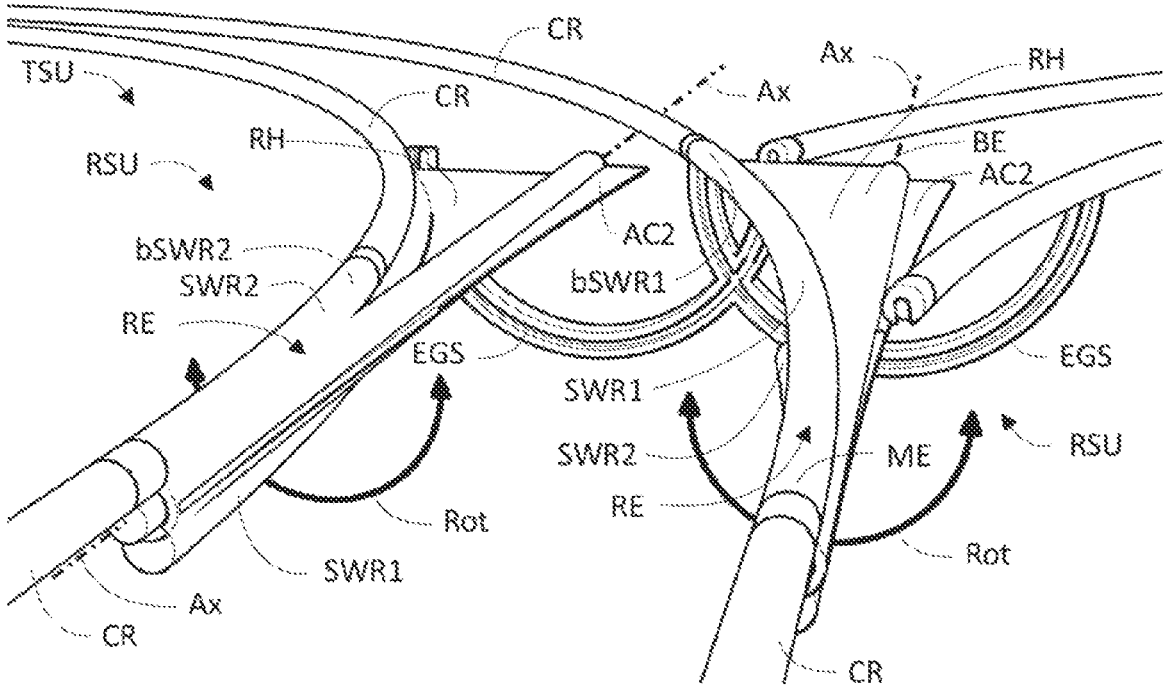
FIG. 25A is a simplified perspective view (from the right of the front/main side) of a track-switching unit with two (left and right) rails switching unit, configured for a 2-ways (leftwards and rightwards) horizontal-layout diverge-point, where a 'leftwards' position has been activated, where rails have round sections and where the crossing of rails is effectively resolved by the track-switching unit, in a possible embodiment of the present invention.

Referring to FIG. 25A, it shows a simplified perspective view (from the right of the front/main side) of a bi-railed track-switching unit (TSU) with two (left and right) rail-switching units (RSU), configured for a 2-ways (leftwards and rightwards) horizontal-layout diverge-point, where a 'leftwards' position has been activated via the rotational movement (Rot) about axis of rotation (Ax), at each rail-switching unit (RSU), of one of the two curved switch-rails (SWR1, SWR2) of each rail-switching unit (RSU) into its active engagement position to provide fully continuous rail vehicle-interacting surfaces, in this case top, bottom and inner-lateral, joining the common rails (CR) placed before and after the track-switching unit (TSU). To activate the 'leftwards' position of the bi-railed track, the left rail-switching unit (RSU) has rotated its higher-curvature inner-curve curved switch-rail (SWR2) into its active engagement position, and the left rail-switching unit (RSU) has rotated its lower-curvature outer-curve curved switch-rail (SWR1) into its active engagement position.

Figure 25B:
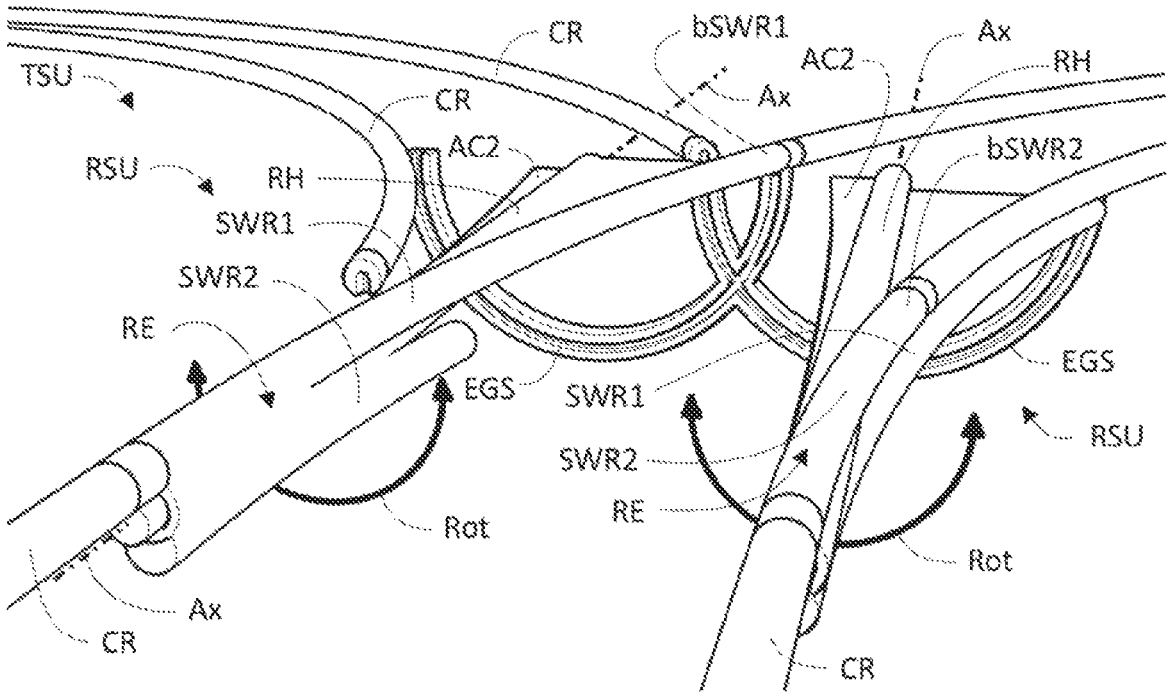
FIG. 25B is the same view of the same track-switching unit of FIG. 25A, but with a 'rightwards' position activated.

Referring to FIG. 25B, it presents the same view of the same track-switching unit of FIG. 25A, but where a 'rightwards' position has been activated via the rotational movement (Rot) about axis of rotation (Ax), at each rail-switching unit (RSU), of one of the two curved switch-rails (SWR1, SWR2) of each rail-switching unit (RSU) into its active engagement position to provide fully continuous rail vehicle-interacting surfaces, in this case top, bottom and inner-lateral, joining the common rails (CR) placed before and after the track-switching unit (TSU). To activate the 'rightwards' position of the bi-railed track, the left rail-switching unit (RSU) has rotated its lower-curvature outer-curve curved switch-rail (SWR1) into its active engagement position, and the right rail-switching unit (RSU) has rotated its higher-curvature inner-curve curved switch-rail (SWR2) into its active engagement position.

Referring to both FIGS. 25A-B, given the fact that the represented horizontal-layout switch-point is not 3-ways, but 2-ways (diverging leftwards and rightwards), potential rail-crossings are limited to the one (not shown) between the leftwards outer-curve rail path and the rightwards outer-curve path. The referred figures illustrate how a track-switching unit (TSU) can be optimally used in a 2-ways horizontal-layout switching point that requires full continuity of vehicle-interacting rail surfaces without excluding existing rail-crossings, fundamentally by configuring each of the rail-switching units (RSU) with a long-enough and adequately shaped outer-curve curved switch-rail (SWR1) with a branch end (bSWR1) that actually surpasses the bisector plane placed between the axis (Ax) of the two rail-switching units (RSU) and with a solid attachment to its rotatable hub (RH). In the shown configuration, the inner-curve curved switch-rails (SWR2) present longitudinal dimensions significantly lower than those of the outer-curve curved switch-rails (SWR1) and they rotate freely without the additional support of an engagement guiding system (EGS) as it is the case of the outer-curve curved switch-rails SWR1. In the referred embodiment, the shapes of the engagement guiding system (EGS) of each rail-switching unit (RSU) overlaps and integrates with each other to avoid potential conflicts with the rotation of the switch-rails, which of course can also only be achieved if the rotational movements of the two rail-switching units (RSU) are properly synchronized.

In the referred embodiment of FIGS. 25A-B, where each rail-switching unit (RSU) comprises only two curved switch-rails (SWR1 and SWR2), having a rotatable ensemble (RE) with a balanced center of mass along its longitudinal dimension in order to provide a perfect or significantly improved alignment of its principal axis of moment of inertia with the axis of rotation (Ax) is possible via, for example, an auxiliary component (AC2) which, being possibly made out of a material of higher specific weight than that the switch-rails, is precisely weighted and shaped to specifically compensate the progressive diverging shape of the switch-rails and is placed opposed from the switch-rails (SWR1 and SWR2) relative to the rotating axis (Ax).

An alternative configuration for the 2-ways horizontal-layout switch-point of FIGS. 25A-B, which is not shown, would be providing each rail-switching unit (RSU) with curved switch-rails having a same longitudinal length (but still different curvature profile) and with engagement guiding systems (EGS) used simultaneously by the branch ends of both curved switch-rails (similarly to the solution shown in FIGS. 10A/B-16, but for a horizontal layout).

Figure 26A:
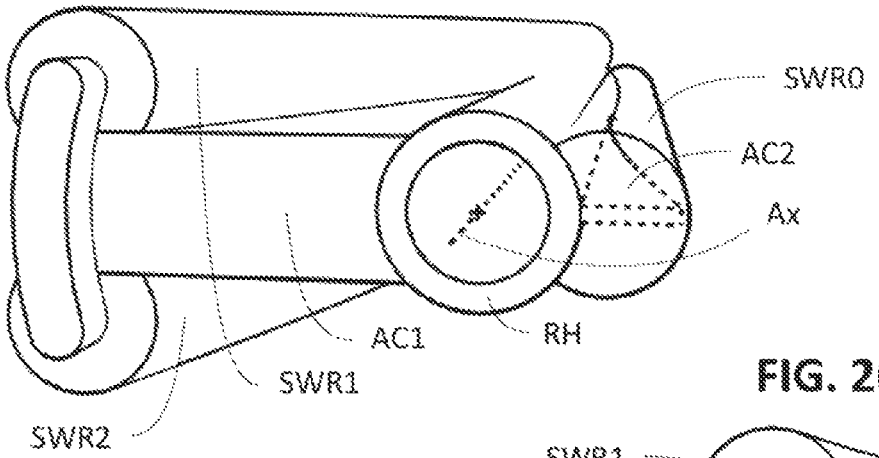
FIG. 26A is a perspective view (from the right of the back/branches side) of a rotary ensemble with supporting and center-of-mass balancing auxiliary components.
Figure 26B:
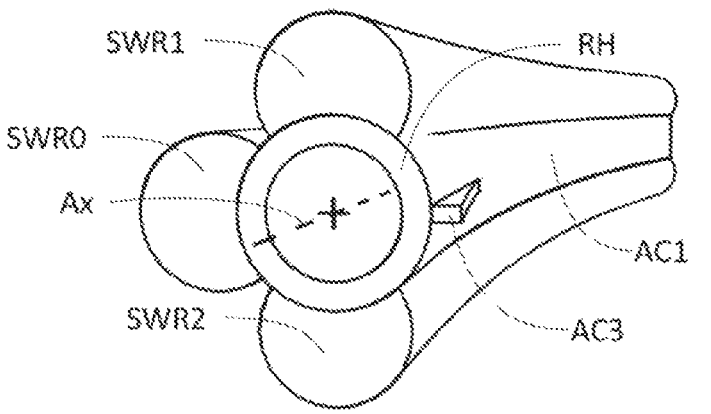
FIG. 26B is a perspective view (from the right of the front/main side) of the same rotary ensemble of FIG. 26A.

Referring to FIGS. 26A-B, they present a simplified representation of a 3-ways rotary ensemble (RE) to illustrate the possibly placement of several center-of-mass balancing auxiliary components (AC2 and AC3) without interfering with vehicle-interacting surfaces of the switch-rails (SWR0/1/2).

FIG. 26A shows a perspective view (from the right of the back/branches side) of a rotary ensemble (RE) with an auxiliary component (AC1) to support the curved switch-rails (SWR1 and SWR2) and an auxiliary component (AC2) that, being possibly made out of a material of higher specific weight than that of the switch-rails, is precisely weighted and shaped to specifically compensate the masses of the longitudinal progressive diverging shapes of the curved switch-rails (SWR1-2) and supporting auxiliary component (AC1) compared to that of the straight switch-rail (SWR0) relative to the axis of rotation (Ax) and is located opposed from the switch-rails (SWR1-2) relative to the rotating axis (Ax), with the particularity of being placed inside the straight switch-rail (SWR0) to avoid obstructing the vehicle-interacting surfaces of said switch-rail.

FIG. 26B shows a perspective view (from the right of the front/main side) of the same rotary ensemble (RE) of FIG. 26A with the auxiliary component (AC1) to support the curved switch-rails (SWR1 and SWR2) and with an auxiliary component (AC3), not shown in FIG. 26A, that, being possibly made out of a material of higher specific weight than that of the switch-rails, is precisely weighted and shaped to specifically compensate the masses of the straight switch-rail (SWR0) compared to those of the longitudinal progressive diverging shapes of the curved switch-rails (SWR1-2) and supporting auxiliary component (AC1) relative to the axis of rotation (Ax), with the particularity of being placed outside of the rotary-hub and supporting auxiliary component (AC1) at a place where there are not vehicle-interacting surfaces and there is no risk of obstructions with vehicle-passing components.

As stated, the purpose of the set of auxiliary components (AC1, AC2, etc.) depicted in FIGS. 26A and 26B is to optimize the physical attributes of the rotatable ensemble and/or to facilitate precise control of the rotational movement of the rotatable ensemble.

In the exemplary embodiment depicted, the set of auxiliary components comprises a variety of plates made out of a material of higher specific weight than that of the switch-rails (SWR0, SWR1, SWR2, etc.). Said plates can be placed attached outside or inside the rotatable hub (RH), and also attached to the bodies of the switch-rails or to the bodies of other auxiliary components without affecting neither rotary movements (Rot) of said rotatable ensemble (RE) nor vehicle movements along vehicle-interacting surfaces of said switch-rails;

In the exemplary embodiment depicted, the plates are shaped along their longitudinal distances with progressively augmenting or diminishing cross-sectional areas to specifically compensate the gradual displacement of the bodies of the diverging switch-rails and their supporting auxiliary components relative to the axis of rotation (Ax) and/or to specifically compensate the gradual necessary/unnecessary compensation of a straight switch-rail (SWR0) relative to curved switch-rails placed at opposed sides from the axis of rotation (Rot).

Supporting Structure

The supporting structure (ST) solidly supports, consolidates and protects elements comprised within the rail-switching unit (RSU) and, if appropriate, also firmly attaches them to the ground and/or to the common guideway structures. An example of the supporting structure (ST) for a rail-switching unit (RSU) is shown in FIG. 18.

Shaft Arrangement

Figure 16B:
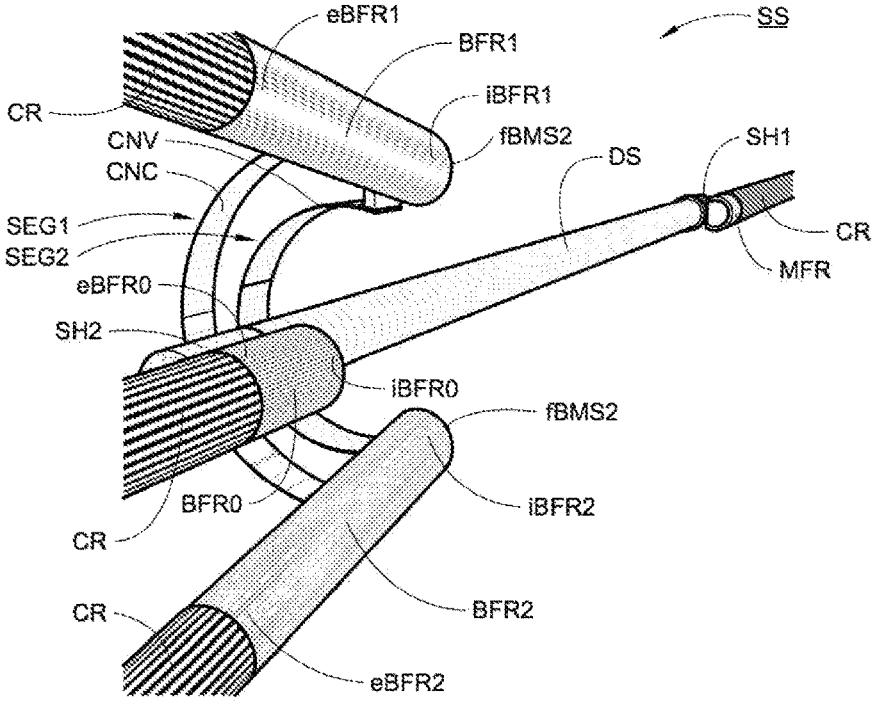
FIG. 16B is a perspective view (from the same point of view of FIG. 15B) of the same presented in FIG. 16A.

The shaft arrangement (SA) supports the rotatable hub (RH) and facilitates its bi-directional rotational movement (Rot) about the axis of rotation (Ax). The shaft arrangement includes either a rotating live-shaft solidly attached to the rotatable hub (RH) and supported through bearings by at least two fixed stationary housings, or—preferably—(as shown in FIGS. 16-17A/B) it includes a fixed stationary dead shaft (DS), supported and locked at its ends by at least two fixed housings (SH1, SH2) and having bearings supporting the rotation of the shaft or "shaft-rotation bearings" (SRB1/2/ . . . ) between the inside surface of the hollow rotatable hub (RH) and the outside surface of the dead shaft (DS), or any combination of the two. The dead shaft (DS) is preferably placed traversing the rotatable hub (RH) through its longitudinal cylindrical hole (CH).

Actuator Arrangement

Figure 17B:
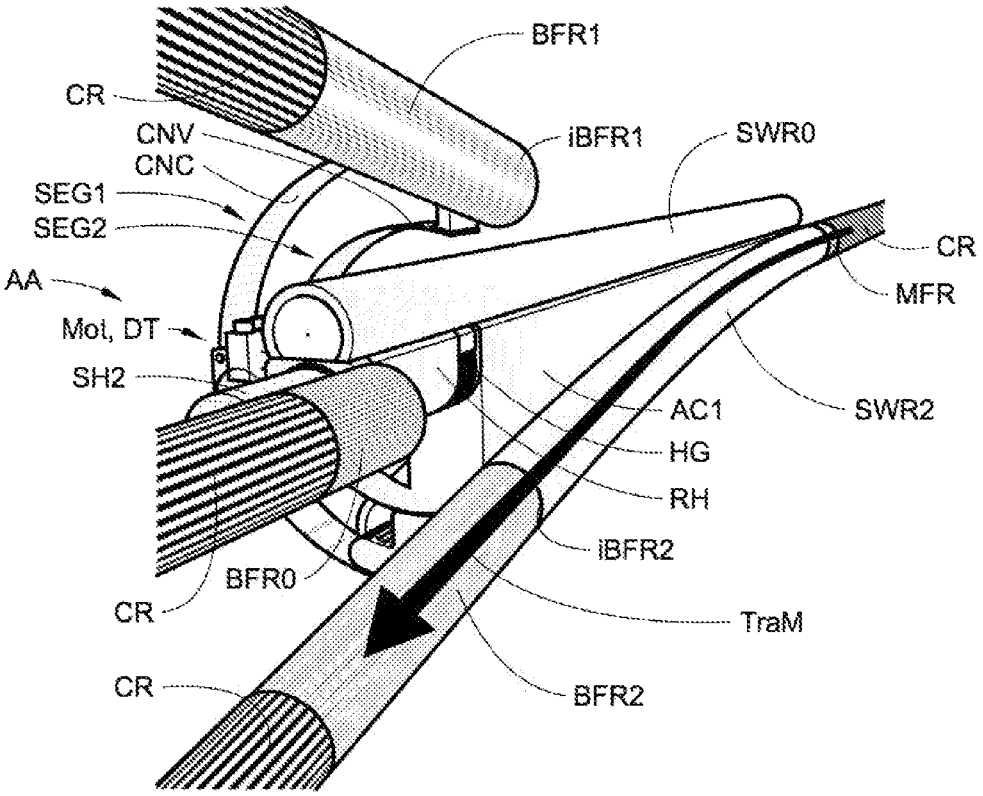
FIG. 17B is a perspective view (from the same point of view of FIGS. 15B and 16B) of the same presented in FIG. 17A, but further including the location of a possible actuator arrangement.

Referring to FIGS. 17B and 18, an actuator arrangement (AA) provides and transmits the necessary drive to directly or indirectly rotate the rotatable hub (RH) and provides the necessary speed and accuracy of rotational driving force to assure rapid and precise rotational movement (Rot) of the switch-rails (SWR0/1/2) into their active positions of engagement. The actuator or motor (Mot) is preferably a servo-motor type or the like, with the capacity of driving bi-directional movement (Rot) with enough speed, with the capacity of controlling angular positions with precision, and with the capacity of holding still in stationary positions. The motor (Mot) is preferably complemented with a gear and pinion mechanism or the like referred as "drive transmission" (DT) for transmitting forces from the actuator to the rotatable hub (RH). The motor (Mot) is preferably located as proximate as possible to the rotatable hub (RH) and in a place of no interference with the movement of the vehicles along the guideway.

The motor (Mot) may actuate on only one rotatable hub (RH) at a time, or simultaneously on two or more rotatable hubs of different rail-switching units (RSU1/2) of a same track-switching unit (TSU).

Engagement-Guiding System

A rail-switching unit (RSU) may preferably be complemented with a system referred as "engagement-guiding system" (EGS) which has the purpose of providing precise and controlled rotational movement of the rotatable hub and the switch-rails (SWR0/1/2/ . . . ) during transitional phases to accurately guide the ends of the switch-rails (mSWR0/1/2/ and bSWR0/1/2/ . . . ) into precise and/or smooth engagement with their corresponding ends of the fixed-rails (iMFR and iBFR0/1/2/ . . . ).

FIGS. 10A/B-12A/B and 15A/B-17A/B present different views and partial sets of components of a three-ways rail-switching unit (RSU) in a preferred embodiment of the invention, wherein the engagement-guiding system (EGS) comprises two stationary engagement guides (SEG1 and SEG2), a set of multiple engagement-guiding bearings (EGB1/2/ . . . ), and one rotatable engagement component (REC) that binds the two branch ends of the curved switch-rails (bSWR1 and bSWR2) into one single piece and is configured to interact simultaneously with the two stationary engagement guides (SEG1 and SEG2).

In this preferred embodiment, a first stationary engagement guide (SEG1) provides one continuous concave guiding surface (CNC) placed in an outermost ring and a second stationary engagement guide (SEG2) provides one continuous convex guiding surface (CNV) placed in an innermost ring, wherein both surfaces (CNC and CNV) are concentric—sharing a same centre in the axis of rotation (Ax) of the rotatable hub (RH)—and have the general shape of an arch approximately covering 180 degrees or somewhat less.

In this embodiment, both stationary engagement guides (SEG1 and SEG2) are solidly fixed to the internal ends of the branch fixed-rails (iBFR1 and iBFR2), wherein the convex guiding surface (CNV) integrates with a female mating surface (fBMS1) located at the internal end of a first curved-path branch fixed-rail (iBFR1) facilitating precise and controlled movement of a first curved switch-rail (SWR1) into an active position of engagement with a corresponding first curved-path branch fixed-rail (BFR1), and wherein the concave guiding surface (CNC) integrates with a female mating surface (fBMS2) located at the internal end of a second curved-path branch fixed-rail (iBFR2) facilitating precise and controlled movement of the second curved switch-rail (SWR2) into an active position of engagement with a corresponding second curved-path branch fixed-rail (BFR2).

The rotatable engagement component (REC) of this embodiment is configured to solidly bind the two branch ends of the curved switch-rails (bSWR1 and bSWR2) and to interact simultaneously with the two stationary engagement guides (SEG1 and SEG2). By having convex and concave curved surfaces designed to perfectly interact with the outer concave guiding surface (CNC) and the inner convex guiding surface (CNV) with the aid of engagement-guiding bearings (EGB1/2/ . . . ), the rotatable engagement component (REC) is able to smoothly rotate between the guiding surfaces (CNC and CNV) and to ultimately achieve accurate and controlled engagement of a switch-rail into an active position.

The engagement-guiding bearings (EGB1/2/ . . . ) of this embodiment are configured to reduce friction and constraint (and control relative motion) between the rotational engagement component (REC) and the guiding surfaces (CNC and CNV). They are preferably cylindrical roller bearings or needle roller bearings and they are preferably placed attached to the branch ends of the curved switch-rails (bSWR1 and bSWR2).

Figure 14:
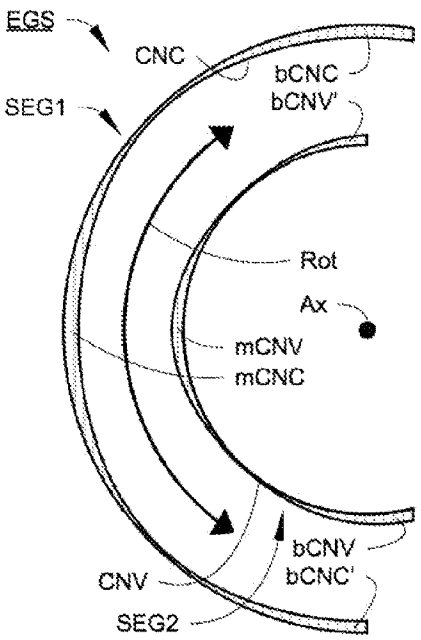
FIG. 14 is a schematic sectional view of an improved engagement-guiding system with two stationary engagement guides (one with a concave engagement surface and another one with a convex engagement surface) where the engagement surfaces present progressive changes of curvature, in a preferred embodiment of the present invention.

Referring to FIG. 14, which represents an extended preferred embodiment of the present invention, the stationary engagement guides (SEG1 and SEG2) do not include guiding surfaces with perfectly circular longitudinal-section shapes but instead present modifications with the purpose of further minimizing slacks, facilitating deceleration of the rotational movement (Rot) of the rotational ensemble about an axis (Ax), and ultimately improving the final speed and accuracy of the connections between fixed-rails and switch-rails when reaching active positions. These modifications, which may further increase the general accuracy and effectiveness of the engagement-guiding system (EGS), consist in that at least one of the concave guiding surfaces (CNC) has a curvature profile with a curvature radius that is slightly and progressively reduced at one or both end sections of the stationary engagement guide (bCNC and bCNC') and/or at the mid-section of the stationary engagement guide (mCNC), and/or at least one of the convex guiding surfaces (CNV) has a curvature profile with a curvature radius that is slightly and progressively increased at one or both end sections of the stationary engagement guide (bCNV and bCNV') and/or at the mid-section of the stationary engagement guide (mCNV).

Track-Switching Unit

The herein disclosed device referred as "track-switching unit" (TSU) allows selective switching of a track segment of a guideway.

A track-switching unit (TSU) comprises one or more rail-switching units (RSU1/2/ . . . ) as the previously described rail-switching unit (RSU), as well as a set of components linked to or part of an electronic operating control system (OCS) and a structure (ST) to support, consolidate and protect the elements of the track-switching unit.

The number of rail-switching units (RSU1/2/ . . . ) in a track-switching unit (TSU) is equal to the number of rails that compose the track segment affected by the track-switching unit.

Congruently with the flexibility of its rail-switching units (RSU1/2/ . . . ), a track-switching unit (TSU) is not limited to "horizontal-layout" track-switching applications (as in FIG. 5), but can alternatively be used in many other cases, such as for example those of "vertical-layout" track-switching applications (as in FIG. 3 or FIG. 4).

When a track-switching unit (TSU) includes more than one rail-switching unit and is operating in a regular mode, its rail-switching units (RSU1/2/ . . . ) are meant to operate in a simultaneous way, but not necessarily by means of mechanical links between them, and not necessarily in a precise synchronous manner.

In their regular mode of operation, rail-switching units (RSU1/2/ . . . ) of a same track-switching unit (TSU) are meant to operate congruently, this is, creating viable track paths of continuity for the vehicles to move along the track-switching unit (TSU).

Congruent operation of rail-switching units is illustrated in FIG. 4 (and in FIG. 3), where a track-switching unit (TSU) in a preferred embodiment of the invention is used in a vertical-layout diverge-point of a bi-railed track. In this example, the two rail-switching units (RSU1 and RSU2) of the track-switching unit (TSU) have been congruently switched—both—into their 'up' active positions by placing their switch-rails (SWR1 and SWR1') in their active positions of engagement. If focusing on the rail-switching unit on the right side of the track (RSU1), a first curved switch-rail (SWR1) is placed in its active position of engagement with a main fixed-rail (MFR) and a corresponding first curved-path branch fixed-rail (BFR1), wherein both fixed-rails are attached to common-rails (CR). If focusing on the rail-switching unit on the left side of the track (RSU1'), a first curved switch-rail (SWR1') is placed in its active position of engagement with a main fixed-rail (MFR', not shown) and a corresponding first curved-path branch fixed-rail (BFR1'). The congruent switching of both rail-switching units (RSU1 and RS2) allows vehicles entering the track-switching unit (TSU) to have their vehicle translational motion (TraM) directed from a main track path (MTP) into a viable track path of continuity, in this case the diverging branch track path that curves upwards (BTP1) and not the one that maintains a straight direction (BTP0) or the one that curves downwards (BTP2).

Figure 5:
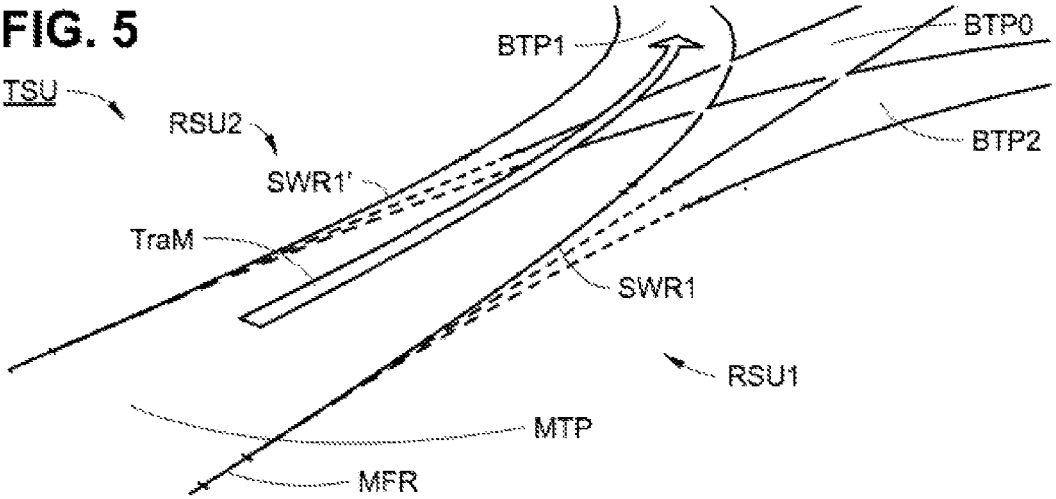
FIG. 5 is a basic schematic perspective view of the case of a horizontal-layout three-diverging ways track-switching problem, solved with a track-switching unit in accordance with a possible embodiment of the invention, possibly appropriate with certain slow and/or heavy-load applications.

Congruent operation of rail-switching units is also illustrated In FIG. 5, where a track-switching unit (TSU) for a horizontal-layout diverge-point of a bi-railed track is presented in a possible embodiment of the invention. In this example, the two rail-switching units (RSU1 and RSU2) of the track-switching unit (TSU) have been congruently both switched into their 'left' active position by placing their switch-rails (SWR1 and SWRP') in their active positions of engagement. This congruent switching of both rail-switching units (RSU1 and RS2) allows vehicles entering the track-switching unit (TSU) to have their vehicle translational motion (TraM) directed from a main track path (MTP) into, in this case, the diverging branch track path that curves leftwards (BTP1) and not the one that maintains a straight direction (BTP0) or the one that curves rightwards (BTP2).

Track-switching units of the present invention (TSU, TSU1/2/3/ . . . ), when configured to allow selection of more than two directions, are especially useful to simplify, improve performance and reduce general costs of track-switching systems (TSS) and thus vehicle-guiding systems (VGS).

Figure 1A:
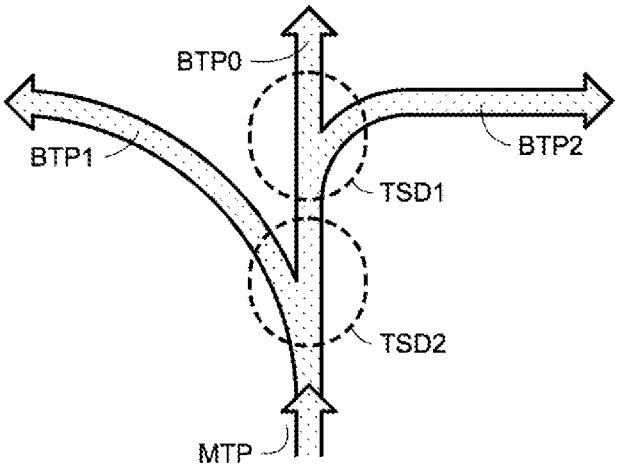
FIG. 1A PRIOR ART
FIG. 1A (PRIOR ART) is a schematic top view of the case of a three-diverging-ways track-switching problem solved with two conventional two-ways track-switching devices disposed sequentially.
Figure 1B:
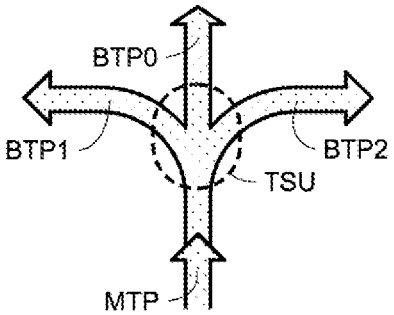
FIG. 1B is the same view of the same problem as in FIG. 1A, but solved with only one track-switching unit in accordance with embodiments of the invention.
Figure 2A:
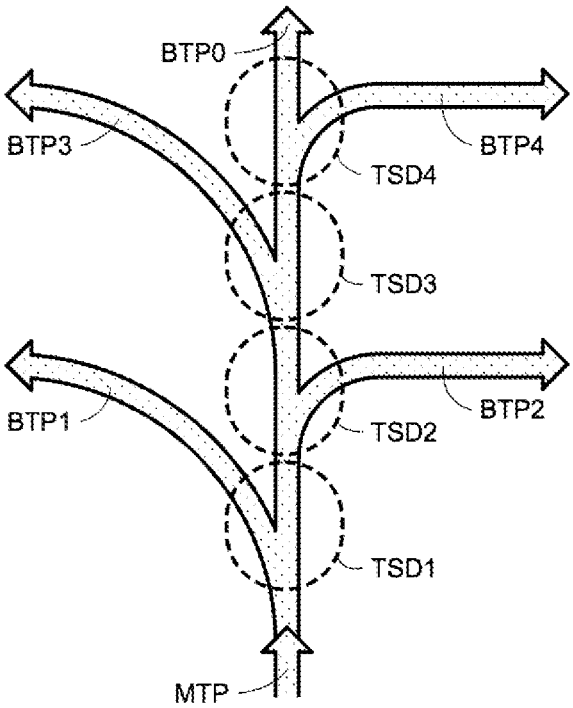
FIG. 2A PRIOR ART
FIG. 2A (PRIOR ART) is a schematic top view of the case of a five-diverging-ways track-switching problem solved with four conventional two-ways track-switching devices disposed sequentially.
Figure 2B:
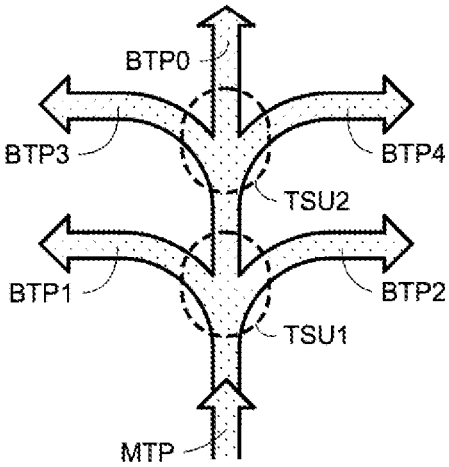
FIG. 2B is the same view of the same problem as in FIG. 2A, but solved with only two track-switching units in accordance with embodiments of the invention.

This is illustrated in example of FIG. 1B (as compared with FIG. 1A) as well as in example of FIG. 2B (as compared with FIG. 2A): FIG. 1A presents a track-switching problem of one main track-path (MTP) diverging into three track-paths (BTP0, BTP1 and BTP2) which is inefficiently solved using two conventional two-ways track-switching devices (TSD1 and TSD2) disposed sequentially; in contrast, FIG. 1B presents the same problem solved with only one track-switching unit (TSU) according to embodiments of the present invention. FIG. 2A presents a track-switching problem of one main track-path (MTP) diverging into five track-paths (BTP0, BTP1, BTP2, BTP3 and BTP4) which is inefficiently solved using four conventional two-ways track-switching devices (TSD1, TSD2, TSD3 and TSD4) disposed sequentially; in contrast, FIG. 2B presents the same problem solved with only two track-switching units (TSU1 and TSU2) according to embodiments of the present invention.

The supporting structure (TSU-ST) solidly supports, consolidates and protects elements comprised within the track-switching unit (TSU) and, if appropriate, also firmly attaches them to the ground and/or to the common guideway structures or integrates them with the supporting structures (ST) of the rail-switching units (RSU1/2/ . . . ).

Design-Guidelines

In the case of vertical track-switching applications where vehicles run along bi-railed tracks and have rail-interacting components such as wheels-assemblies (WA) with sets of wheels (tW, sW or bW) that wrap in more or less extent around a rail (CR) (as shown in FIG. 6B, in contrast with FIG. 6A), certain configuration and design guidelines, referred as "design-guidelines" (DG1-5), are preferable. These design-guidelines apply directly to the design/configuration of segments of guideway that are adjacent to the track-switching units (TSU1/2/3/ . . . ) and consequently they also affect the general design of the whole guideway as well as the design of the vehicle-body (VB) and rail-interacting components of the vehicles that move along the guideways.

The ultimate purpose of these design-guidelines is to potentially improve the performance and costs (of fabrication, installation, operation, maintenance . . . ) of the track-switching units (TSU1/2/3/ . . . ), the track-switching system (TSS) and the vehicle-guiding system (VGS). This is achieved by means of an overall simplification and size-reduction of the rail-switching units (RSU1/2/ . . . ), the track-switching units (TSU1/2/3/ . . . ) and their supporting structures (TSU-ST), as well as of the associated guideways and vehicles, but always under the condition of providing minimal guideway clearance for the passing of the vehicles through the track-switching units (TSU1/2/3/ . . . ) whilst avoiding any possible inadequate interference of the vehicles with other elements of the vehicle-guiding system (VGS) such as unused branch fixed-rails (BFR0/1/2/ . . . ) or proximate track segments that diverge from the track-switching unit (TSU1/2/3/ . . . ) or merge into it.

Design Guideline 1

Figure 7A:
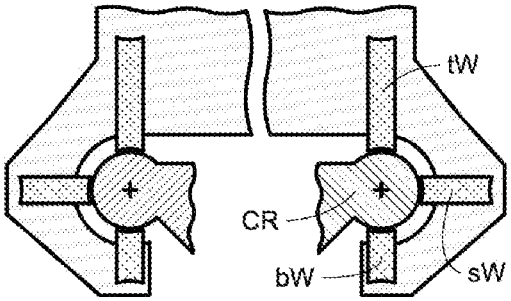
FIG. 7A PRIOR ART
FIG. 7A (PRIOR ART) is a schematic front cross-sectional view presenting the example of a bi-railed track—and wrapping wheels-assemblies—where the rails are supported from the inside of the track and the wheels-assemblies wrap the rails from the outside of the track, application for which rail-switching units of the present invention can be used but not according with a preferred embodiment.
Figure 7B:
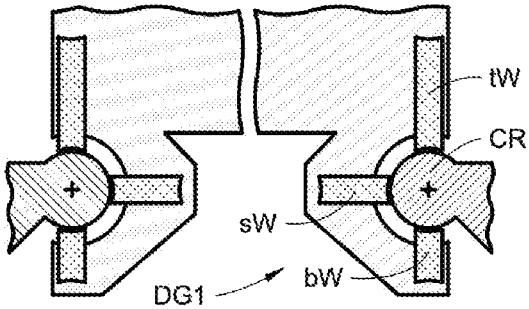
FIG. 7B PRIOR ART
FIG. 7B (PRIOR ART) is a schematic front cross-sectional view presenting the example of a bi-railed track—and wrapping wheels-assemblies—where the rails are supported from the outside of the track and the wheels-assemblies wrap the rails from the inside of the track, application for which a track-switching unit of the present invention can be used in accordance with a preferred embodiment.

Referring to FIG. 7B (in contrast with FIG. 7A), a first design guideline (DG1) includes supporting of the guideway rails (CR) from the outside of the track and wrapping of the sets of wheels (tW, sW and bW) of the wheels-assemblies (WA) around the rails (CR) from the inside of the track.

FIG. 7A shows the opposite: guideway rails supported from the inside and wheels-assemblies wrapping around rails from the outside.

This first design guideline implies significant potential reduction and simplification of the rail-switching units (RSU1/2/ . . . ), the track-switching units (TSU1/2/3/ . . . ), the track-switching systems (TSS) and the vehicle-guiding system (VGS), mainly if the design guideline is applied in conjunction with following design-guidelines 2, 3, 4 and 5 (DG2-5).

Design Guideline 2

Figure 8:
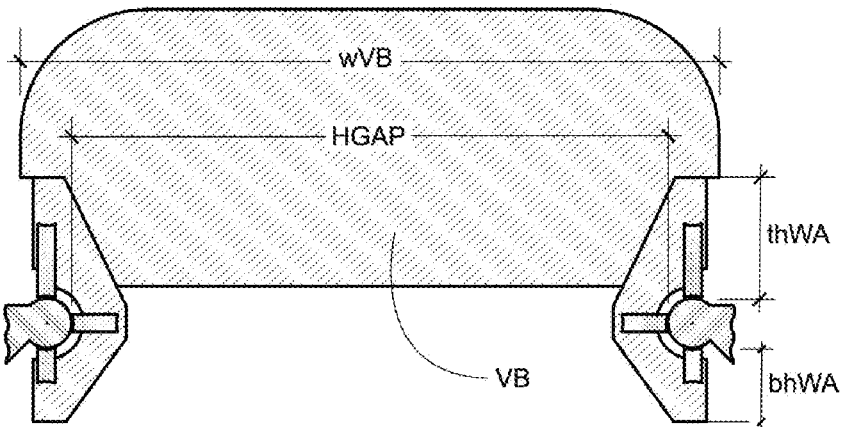
FIG. 8 PRIOR ART
FIG. 8 (PRIOR ART) is a schematic cross-sectional view presenting the example of a bi-railed track—and a corresponding track-vehicle—where the design-guidelines proposed in the invention are not followed, application for which a track-switching unit of the present invention can be used but not according with a preferred embodiment.
Figure 9:
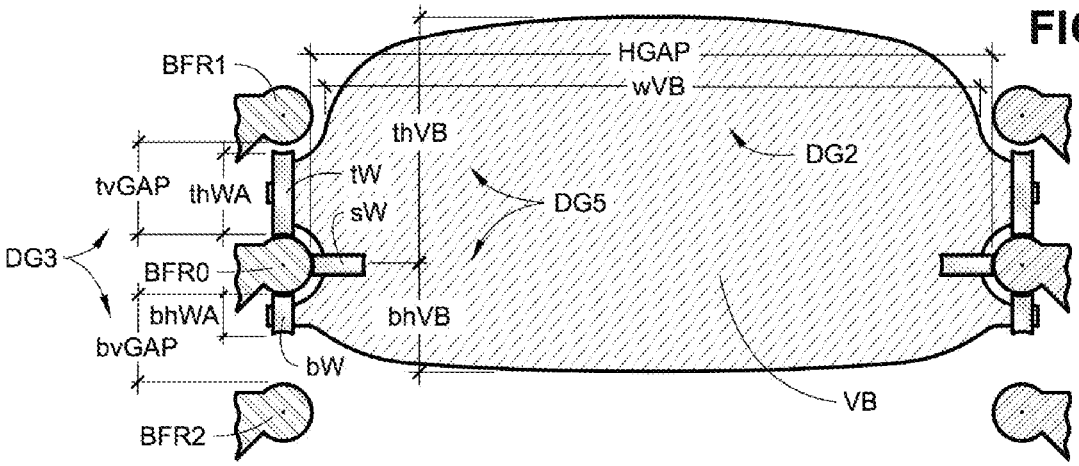
FIG. 9 is a schematic cross-sectional view presenting the example of a diverge-point of a bi-railed track in which the track-switching unit—and the track-vehicle—follow design-guidelines according with a preferred embodiment of the invention.

Referring to FIG. 9 (in contrast with FIG. 8), a second design guideline (DG2) includes adapting the width of the track (HGAP)—and/or adapting the maximal width of the vehicle body (VB) without considering the wheels-assemblies (WA) or "width of vehicle body" (wVB)—so the vehicle, when directed through a track-switching unit (TSU), is able to fit—avoiding any inadequate interferences—within the horizontal gap between a pair of rails of a same track (HGAP). This is, the track horizontal gap (HGAP) is greater than the vehicle body width (wVB).

Design Guideline 3

Referring to FIG. 9 (in contrast with FIG. 8), a third design guideline (DG3) includes minimizing vertical clearance gaps above and below the rails (tvGAP and bvGAP)—and/or minimizing the top height of the wheels-assembly (thWA) to the height of its top wheels (tW) and/or minimizing the bottom height of the wheels-assembly (bhWA) to the height of its bottom wheels (bW)—so the wheels-assemblies can pass without interferences through minimal vertical gaps (tvGAP and bvGAP). Following this design guideline implies that a top vertical gap (tvGAP) is greater than the top height of the wheels-assembly (thWA) and/or that a bottom vertical gap (bvGAP) is greater than the bottom height of the wheels-assembly (bhWA). FIG. 9 illustrates gap clearances above and below a certain longitudinal point of a central-path branch fixed-rail (BFR0) that would be engaged with a corresponding central switch-rail (SWR0, not shown in FIG. 9), but these gap clearances should be assured also for the other rails (BFR1, BFR2) and along the whole track-switching unit (TSU) irrespective of its selected active position and taking into account that a bottom vertical gap (bvGAP) of one rail can also be the top vertical gap (tvGAP) of another rail (or vice versa) and that the internal ends of the branch fixed-rails (iBFR0/1/2, not shown in FIG. 9) do not necessarily have to be aligned or in a same plane.

Design Guideline 4

Referring to FIG. 3, a fourth design guideline (DG4) includes progressive vertical distancing/approximating of the tracks in diverge/merge-points, avoiding any lateral turns of the tracks in a portion of the guideways referred as "straight-guideways segment" (SGS) that is linked to the branch fixed-rails and thus is adjacent to the track-switching unit (TSU).

FIG. 3 represents the specific the case of a diverge-point with one main track-path (MTP) possibly diverging into three track-paths (BTP0, BTP1 and BTP2) in which the vehicle translational motion (TraM) follows a selected 'upwards' track path (BTP1). In this case, the purpose of the fourth design-guideline (DG4) is to direct vehicles coming out of the track-switching unit (TSU) in a horizontally-straight direction (without turns left or right) through a straight-guideways segment (SGS) until reaching vertical gaps above or below diverging tracks (e.g. vGAP1 and vGAP2) that are sufficient for the vehicles to be directed along branch tracks paths that turn outwardly (BTP1 and BTP2) whilst avoiding any possible inadequate interferences with other diverging tracks from the same track-switching unit (TSU).

In the case of merge-points, the purpose of the fourth design-guideline (DG4) is to direct vehicles approximating to a track-switching unit in a horizontally-straight direction after having reached vertical gaps above or below converging tracks that are not sufficient for the vehicles to be directed along turning tracks whilst avoiding any possible inadequate interference with other converging tracks into the same track-switching unit.

Design Guideline 5

Referring to FIG. 9 (in contrast with FIG. 8) and specifically shown in FIG. 4, a fifth design-guideline (DG5) includes reducing the longitudinal length of the straight-guideways segment (ISGS) derived from the fourth design-guideline (DG4) by means of reducing as possible the top height of the vehicle body (thVB) and/or reducing as possible the bottom height of the vehicle body (bhVB). This fifth design guideline (DG5) minimizes the design restrictions from the fourth design-guideline (DG4) whilst seeking multiple other potential benefits to the vehicle-guiding system (VGS) such as those derived from minimizing moments of inertia of the vehicle.

Track-Switching System

The herein disclosed system referred as "track-switching system" (TSS) allows coordinated and controlled selective switching of multiple track segments of a guideway.

A track-switching system (TSS) comprises one or more track-switching units (TSU1/2/3 . . . ) as the previously described track-switching unit (TSU), an electronic operating control system (OCS), and a supporting structure (TSS-ST).

The track-switching units (TSU1/2/3 . . . ) are as the previously described track-switching unit (TSU).

The electronic operating control system (OCS) manages the one or more track-switching units (TSU1/2/3/ . . . ), including activating, coupling, verifying, maintaining and controlling the functioning of the track-switching units (TSU1/2/3/ . . . ) and their rail-switching units (RSU1/2/ . . . ).

The supporting structure (TSS-ST) solidly supports, consolidates and protects elements comprised within the track-switching system (TSS) and, if appropriate, also firmly attaches them to the ground and/or to the common guideway structures or integrates them with the supporting structures (ST) of the track-switching units (TSU1/2/ . . . ).

Variations to the Invention

Although the invention has been explained in relation to its preferred embodiment(s), it is to be understood that many other possible modifications and variations, or combinations of them, can be made without departing from the scope of the present invention. It is, therefore, contemplated that the appended claim or claims will cover such modifications and variations (as well as combinations of them) that fall within the true scope of the invention. Some of those modifications and variations may be originated in specific requirements such as the following:

- adaptation to a two-ways track-switching application (among other possible changes, by removing one or more of the switch-rails and/or one or more of the branch fixed-rails and associated elements, or by simplifying, reducing, modifying or suppressing structure elements as well as blocking, halting, or movement guiding mechanisms);
- adaptation to a more-than-three-ways track-switching application (among other possible changes, by installing additional switch-rails and branch fixed-rails or by installing a consecutive set of three-ways track-switching systems);
- adaptation to merge-point application applications (among other possible changes, by modifying the positioning and orientation of the track-switching units);
- adaptation to a horizontal-layout track-switching application such as that of a common railway (among other possible changes, by positioning the rail-switching units below the rails and orienting them facing upwards, and/or by modifying the structural and supporting components, and/or by reinforcing the rotation blocking mechanisms);
- adaptation to applications where the track plane is inclined (among other possible changes, by adequately positioning and orienting the rail-switching units);
- adaptation to applications where the curved switch-rails have the same curvature profile, or where all switch-rails have the same longitudinal length (among other possible changes, by adapting and simplifying the rotatable hub, rotating guides and the structures);
- adaptation to applications where the internal ends of the branch fixed-rails do not form a plane (among other possible changes by varying the range of angular movements of the rotatable hub);
- adaptation to applications where the curved switch-rails have different longitudinal lengths (among other possible changes, by adapting the rotatable hub, rotating guides and the structures);
- adaptation to applications where the straight switch-rails may not be perfectly straight, or the curved-rails may not be uniformly curved (among other possible changes, by adapting accordingly the shapes of the switch-rails and corresponding fixed-rails);
- adaptation to applications where one actuator is shared by several rail-switching units (among other possible changes, by providing a direct or indirect mechanical link between the rail-switching units upon which a same actuator would, directly or indirectly, transmit the rotational force);
- adaptation to vertical-layout track-switching applications where the track rails are not supported from the outside lateral sides of the track, but from the internal lateral sides of the rails (among other possible changes, by positioning the rail-switching units inside the track and orienting them facing outwards);

adaptation to applications where the track rails are supported from above (among other possible changes, by modifying the positioning the rail-switching units above the rails and orienting them downwards);

adaptation to applications with stricter safety, reliability and/or performance requirements (among other possible changes, by providing additional blocking, halting, or movement guiding mechanisms, or reinforcing the described ones, and/or by using additional mechanical or magnetic methods to improve the engagement of switch-rails with fixed-rails at their active positions, and/or by adapting the covers and structures so as to maximize the solidness and precision of the system and minimize the probability of interferences with the mechanisms);

adaptation to applications with laxer safety and/or performance requirements (among other possible changes, by adapting, simplifying or discarding the described blocking, halting, and movement/engagement guiding mechanisms);

adaptation to applications requiring a wheels-assembly covering only two sides or only one side of the rail (among other possible changes, by modifying and simplifying the switch-rail and fixed-rail profiles);

adaptation to applications requiring different shapes, profiles and contacts between wheels and rail surfaces (among other possible changes, by modifying the switch-rail and fixed-rail profiles);

adaptation to mono-rail applications (among other possible changes, by reducing to one the number of rail-switching units per track-switching unit, or by simplifying the control system);

adaptation to applications where the vehicle moves along more than two rails (among other possible changes, by increasing to more than two the number of rail-switching units per track-switching unit);

adaptation to applications where the vehicles are suspended from and below the rails (among other possible changes, by modifying the positioning and orientation of the rail-switching units);

adaptation to applications with restricted g-forces (among other possible changes, by modifying the longitudinal length and shape of the switch-rails, and/or by adapting the rotating guides and the structures);

adaptation to applications where the movement of the vehicles along the guideway is not provided by means of rolling wheels, but by means of alternative technologies (or a mix of them), such as, for example, electromagnetic levitation, direct contact sliding, air-cushioning, or continuous rolling tracks (among other possible changes, by adapting the shape profiles of switch-rails and fixed-rails, and/or by modifying the positioning and orientation of the rail-switching units);

adaptation to crossing-points or applications where switching is needed to establish right connections between several inbound and outbound rails (among other possible changes, by combining rail-switching units for diverge-points and merge-points, by adapting the shape profiles of switch-rails and fixed-rails to allow minimal physical discontinuities at the rail crossings, by modifying the general shape, positioning and orientation of the rail-switching units, or by modifying the tracks layout so as to minimize possible crossing conflicts);

adaptation to other guideway-switching applications where the vehicles may move along the inside of guideways with tubular forms (among other possible changes, by modifying the mating profiles);

adaptation to other guideway-switching applications where vehicles move along the guideways not with a primary purpose of conveying goods or transporting passengers, but with secondary purposes such as those of maintenance or supervision of the guideways.

What is claimed is:

1. A rail-switching unit, for using to switch only one rail segment at a time, functioning either singly in a track-switching unit of a mono-railed track or combined with other same units in a track-switching unit of a multi-railed track, wherein the rail-switching unit comprises:

a rotatable set of components, wherein the rotatable set of components is a rotatable ensemble, and a stationary set of components, wherein the stationary set of components is a stationary set;

the rotatable ensemble further comprises:

a rotatable hub, a set of two, three or more switch-rails, wherein at least two of the set of two, three or more switch-rails are provided with a curved shape, a set of auxiliary components to facilitate an attachment of the set of two, three or more switch-rails to the rotatable hub to optimize physical attributes of the rotatable ensemble or to facilitate a precise control of a rotational movement of the rotatable ensemble;

the stationary set further comprises:

a main fixed-rail, a set of two, three or more branch fixed-rails, a supporting structure, wherein the supporting structure solidly supports, consolidates and protects elements comprised within the rail-switching unit and firmly attaches the main fixed rail and the set of two, three or more branch fixed-rails to a ground or to common guideway structures;

wherein the main fixed-rail is solidly fixed to a standard stationary rail called a common-rail at an external end of the main fixed-rail or an end of the main fixed-rail, wherein the end of the main fixed-rail is furthest in distance from the rotatable ensemble and opposite to an internal end of the main fixed-rail;

wherein the set of two, three or more branch fixed-rails are fixed to the common-rail at external ends of the set of two, three or more branch fixed-rails or ends of the set of two, three or more branch fixed-rails, wherein the ends of the set of two, three or more branch fixed-rails are furthest in distance from the rotatable ensemble and are opposite to internal ends of the set of two, three or more branch fixed-rails;

wherein a number of the set of two, three or more switch-rails is equal to a number of the set of two, three or more branch fixed-rails;

wherein each of the set of two, three or more switch-rails is configured to allow an activation of the each of the set of two, three or more switch-rails, engagement into a stationary operative position called an active position of an alignment or a connection with a corresponding branch fixed-rail;

wherein the each of the set of two, three or more switch-rails is fixedly attached at a distance from an axis of rotation of the rotatable hub, wherein a rotational movement of the rotatable hub about the axis of rotation allows a selective activation of the each of the set of two, three or more switch-rails with the corresponding branch fixed-rail;

wherein the activation of the set of two, three or more switch-rails involves aligning or connecting a main end with the internal end of the main fixed-rail and aligning or connecting a branch end with a corresponding internal end of the corresponding branch fixed-rail with a purpose of bi-directionally conveying or guiding vehicles through the rail-switching unit, either from the main fixed-rail into any of the set of two, three or more branch fixed-rails, or from any of the set of two, three or more branch fixed-rails into the main fixed-rail, or simultaneously allowing both directions of movement;

wherein the internal ends of the set of two, three or more branch fixed-rails are separated at fixed distances between each other providing necessary gap clearance spaces for rail-wrapping assemblies of the vehicles to be adequately guided without interferences through the rail-switching unit;

wherein the rotatable ensemble is configured in a compact way to optimize physical attributes of a volume, a mass, a solidness or a moment of inertia about the axis of rotation of the rotatable ensemble, wherein planes containing rail curved-paths of at least two curved switch-rails are parallel to each other and to the axis of rotation and equidistantly distanced from the axis of rotation;

a straight switch-rail has a rail path, wherein the rail path is straight and parallel to the axis of rotation and the branch end of the straight switch-rail is located at a first side, wherein the first side is relative to the axis of rotation, the branch end of the straight switch-rail is opposite from a second side, wherein branch ends of the at least two curved switch-rails are located at the second side;

curved switch-rail main-ends of the at least two curved switch-rails are diametrically opposed from the axis of rotation; and switch-rail main-ends are configured within a same plane and at a same perpendicular distance from the axis of rotation.

2. The rail-switching unit of claim 1, wherein the main fixed-rail and the set of two, three or more switch-rails are shaped or configured to allow an engagement between the internal end of the main fixed-rail and any of main ends of the set of two, three or more switch-rails by mating profiles at the main ends, wherein the mating profiles at the main ends are main mating profiles;

And wherein the set of two, three or more branch fixed-rails and the set of two, three or more switch-rails are shaped or configured to allow an engagement between the internal ends of the set of two, three or more branch fixed-rails and corresponding branch ends of the set of two, three or more switch-rails by mating profiles at the corresponding branch ends, wherein the mating profiles at the corresponding branch ends are branch mating profiles;

wherein each of the main mating profiles comprises:

a female main mating surface, wherein the female main mating surface is present on the internal end of the main fixed-rail, and a male main mating surface, wherein the male main mating surface matches the female main mating surface and the male main mating surface is present on any of the main ends of the set of two, three or more switch-rails;

wherein each of the branch mating profiles comprises a female branch mating surface, wherein the female branch mating surface is present on any of the internal ends of the set of two, three or more branch fixed-rails;

and a male branch mating surface, wherein the male branch mating surface matches a corresponding female branch mating surface, and the male branch mating surface is present on any of the corresponding branch ends of the set of two, three or more switch-rails;

and wherein the mating profiles are configured to allow a firm connection between the set of two, three or more switch-rails and the set of two, three or more branch fixed-rails and are configured to facilitate the movement of the set of two, three or more switch-rails into and out of active positions of engagement with corresponding branch fixed-rails.

3. The rail-switching unit of claim 2, wherein at least one of the mating profiles is designed and configured to facilitate halting a continuity of the rotational movement of the rotatable ensemble when a certain active position of a switch-rail of the set of two, three or more switch-rails is reached, to facilitate maintaining the certain active position of the switch-rail, and to facilitate a reversal of a direction of the rotational movement of the rotatable ensemble in order to come out of the certain active position of the switch-rail;

and wherein the at least one of the mating profiles is configured to facilitate a controlled movement of the set of two, three or more switch-rails into and out of the active positions of engagement with the corresponding branch fixed-rails by specific shapes of male and female mating surfaces or by using one or more sets of mating profile bearings, wherein the one or more sets of the mating profile bearings are sets of bearings or other auxiliary mechanisms to reduce a friction or control a relative movement between surfaces, wherein the surfaces are integrated with one or both of the male and female mating surfaces.

4. The rail-switching unit of claim 3, wherein the set of two, three or more switch-rails consists of the switch-rail with a straight shape and called a straight switch-rail, a first switch-rail with a curved shape and called a first curved switch-rail, and a second switch-rail with the curved shape and called a second curved switch-rail;

wherein the set of two, three or more branch fixed-rails consists of a fixed-rail shaped or configured to be connected with the straight switch-rail and called a straight-path branch fixed-rail, a fixed-rail shaped or configured to be connected with the first curved switch-rail and called a first curved-path branch fixed-rail, and a fixed-rail shaped or configured to be connected with the second curved switch-rail and called a second curved-path branch fixed-rail;

wherein when the straight switch-rail is rotated into the active position, the straight switch-rail engages simultaneously on the main end with the main fixed-rail and on the branch end with a corresponding straight-path branch fixed-rail;

wherein when the first curved switch-rail is rotated into the active position, the first curved switch-rail engages simultaneously on the main end with the main fixed-rail and on the branch end with a corresponding first curved-path branch fixed-rail;

wherein when the second curved switch-rail is rotated into the active position, the second curved switch-rail engages simultaneously on the main end with the main fixed-rail and on the branch end with a corresponding second curved-path branch fixed-rail;

wherein engagements between the set of two, three or more switch-rails and corresponding branch fixed-rails provide a continuous running surface or a continuous connection between the switch-rail and the corresponding branch fixed-rail in a bi-directional way, wherein the bi-directional way is in a first direction, in a second direction, or in both of the first direction and the second direction.

5. The rail-switching unit of claim 3, further comprising:

an actuator arrangement to provide and transmit a necessary drive for the rotational movement of the rotatable ensemble;

wherein the actuator arrangement is configured to actuate on only one rotatable ensemble or simultaneously on two or more rotatable ensembles of different rail-switching units.

6. The rail-switching unit of claim 2, wherein the set of two, three or more switch-rails consists of the switch-rail with a straight shape and called a straight switch-rail, a first switch-rail with a curved shape and called a first curved switch-rail, and a second switch-rail with the curved shape and called a second curved switch-rail;

wherein the set of two, three or more branch fixed-rails consists of a fixed-rail shaped or configured to be connected with the straight switch-rail and called a straight-path branch fixed-rail, a fixed-rail shaped or configured to be connected with the first curved switch-rail and called a first curved-path branch fixed-rail, and a fixed-rail shaped or configured to be connected with the second curved switch-rail and called a second curved-path branch fixed-rail;

wherein when the straight switch-rail is rotated into the active position, the straight switch-rail engages simultaneously on the main end with the main fixed-rail and on the branch end with a corresponding straight-path branch fixed-rail;

wherein when the first curved switch-rail is rotated into the active position, the first curved switch-rail engages simultaneously on the main end with the main fixed-rail and on the branch end with a corresponding first curved-path branch fixed-rail;

wherein when the second curved switch-rail is rotated into the active position, the second curved switch-rail engages simultaneously on the main end with the main fixed-rail and on the branch end with a corresponding second curved-path branch fixed-rail;

wherein engagements between the set of two, three or more switch-rails and corresponding branch fixed-rails provide a continuous running surface or a continuous connection between the switch-rail and the corresponding branch fixed-rail in a bi-directional way, wherein the bi-directional way is in a first direction, in a second direction, or in both of the first direction and the second direction.

7. The rail-switching unit of claim 2, further comprising:

an actuator arrangement to provide and transmit a necessary drive for the rotational movement of the rotatable ensemble;

wherein the actuator arrangement is configured to actuate on only one rotatable ensemble or simultaneously on two or more rotatable ensembles of different rail-switching units.

8. The rail-switching unit of claim 1, wherein the set of two, three or more switch-rails consists of the switch-rail with a straight shape and called a straight switch-rail, a first switch-rail with a curved shape and called a first curved switch-rail, and a second switch-rail with the curved shape and called a second curved switch-rail;

wherein the set of two, three or more branch fixed-rails consists of a fixed-rail shaped or configured to be connected with the straight switch-rail and called a straight-path branch fixed-rail, a fixed-rail shaped or configured to be connected with the first curved switch-rail and called a first curved-path branch fixed-rail, and a fixed-rail shaped or configured to be connected with the second curved switch-rail and called a second curved-path branch fixed-rail;

wherein when the straight switch-rail is rotated into the active position, the straight switch-rail engages simultaneously on the main end with the main fixed-rail and on the branch end with a corresponding straight-path branch fixed-rail;

wherein when the first curved switch-rail is rotated into the active position, the first curved switch-rail engages simultaneously on the main end with the main fixed-rail and on the branch end with a corresponding first curved-path branch fixed-rail;

wherein when the second curved switch-rail is rotated into the active position, the second curved switch-rail engages simultaneously on the main end with the main fixed-rail and on the branch end with a corresponding second curved-path branch fixed-rail;

wherein engagements between the set of two, three or more switch-rails and corresponding branch fixed-rails provide a continuous running surface or a continuous connection between the switch-rail and the corresponding branch fixed-rail in a bi-directional way, wherein the bi-directional way is in a first direction, in a second direction, or in both of the first direction and the second direction.

9. The rail-switching unit of claim 8, wherein the first curved switch-rail and the second curved switch-rail have different curvature profiles.

10. The rail-switching unit of claim 8, further comprising:

an actuator arrangement to provide and transmit a necessary drive for the rotational movement of the rotatable ensemble;

wherein the actuator arrangement is configured to actuate on only one rotatable ensemble or simultaneously on two or more rotatable ensembles of different rail-switching units.

11. The rail-switching unit of claim 1, further comprising:

an actuator arrangement to provide and transmit a necessary drive for the rotational movement of the rotatable ensemble;

wherein the actuator arrangement is configured to actuate on only one rotatable ensemble or simultaneously on two or more rotatable ensembles of different rail-switching units.

12. The rail-switching unit of claim 1, further comprising:

a position-blocking mechanism, wherein the position-blocking mechanism is a mechanism to block angular positions of the rotatable ensemble, to assure or reaffirm a precision and a solidness of an engagement between the set of two, three or more switch-rails and the set of two, three or more branch fixed-rails by allowing firm, fast and timely blocking and unblocking of the rotatable ensemble by a multi-point latch mechanism operated by a control system or mechanically linked with an angular movement of the rotatable hub;

wherein the position-blocking mechanism is configured to operate on only one rotatable ensemble or on two or more rotatable ensembles of different rail-switching units.

13. The rail-switching unit of claim 1, further comprising an engagement-guiding system with a purpose of providing a controlled rotational movement of the rotatable hub and the set of two, three or more switch-rails during transitional phases, and of accurately guiding ends of the set of two, three or more switch-rails into precise and smooth engagement with corresponding ends of the set of two, three or more branch fixed-rails.

14. The rail-switching unit of claim 13, wherein the engagement-guiding system comprises:

a set of one or more stationary engagement guides, a set of one or more engagement-guiding bearings, and a set of one or more rotatable engagement components;

wherein the set of one or more engagement-guiding bearings are cylindrical roller bearings or needle roller bearings or any other auxiliary mechanisms to reduce a friction and control a relative movement between surfaces, are configured to facilitate an interaction between stationary surfaces of the set of one or more stationary engagement guides and moving surfaces of the set of one or more rotatable engagement components to accurately control a relative motion of the stationary surfaces and the moving surfaces and to reduce a potential friction and a constraint between the stationary surfaces and the moving surfaces, with an ultimate objective of achieving a fast, smooth and precise engagement between the set of two, three or more switch-rails and corresponding branch fixed-rails;

and wherein the set of one or more rotatable engagement components provide the surfaces to interact with the set of one or more stationary engagement guides directly or by the set of one or more engagement-guiding bearings, are fixed to the rotatable ensemble, integrate with the rotatable hub and the set of two, three or more switch-rails and the set of auxiliary components, and integrate with mating profile surfaces at the ends of the set of two, three or more switch-rails.

15. The rail-switching unit of claim 14, wherein the set of one or more stationary engagement guides comprises:

the one or more stationary engagement guides placed in outermost rings and presenting guiding surfaces with an inward curving called concave guiding surfaces, and the one or more stationary engagement guides placed in innermost rings and presenting the guiding surfaces with an outward curving called convex guiding surfaces;

wherein when the concave guiding surfaces and the convex guiding surfaces are continuous, the concave guiding surfaces and the convex guiding surfaces have a general shape of an arch covering up to 180 degrees;

wherein the concave guiding surfaces or the convex guiding surfaces are fundamentally concentric and share a same axis of rotation of the rotatable hub;

and wherein the concave guiding surfaces or the convex guiding surfaces adjacent to an internal end of a branch fixed-rail are fixed to the internal end of the branch fixed-rail and configured to allow the smooth and precise engagement of an end of a switch-rail and a mating profile of the switch-rail if the mating profile of the switch-rail is present with a corresponding end of the branch fixed-rail and a mating profile of the branch fixed-rail if the mating profile of the branch fixed-rail present.

16. The rail-switching unit of claim 15, wherein, with a purpose of minimizing slacks, facilitating a deceleration of the rotational movement of the rotational ensemble, and thus improving a final speed and an accuracy of connections between the set of two, three or more branch fixed-rails and the set of two, three or more switch-rails when reaching active positions, at least one of the concave guiding surfaces has a curvature profile with a curvature radius slightly and progressively reduced at one or both end sections of the set of one or more stationary engagement guides or at a mid-section of the set of one or more stationary engagement guides, and at least one of the convex guiding surfaces has the curvature profile with the curvature radius slightly and progressively increased at the one or both end sections of the set of one or more stationary engagement guides or at the mid-section of the set of one or more stationary engagement guides.

17. The rail-switching unit of claims 15, wherein at least one of the set of one or more rotatable engagement components is shaped integrating matching profiles of different branch ends of the set of two, three or more switch-rails and providing surfaces allowing simultaneous interaction with the concave guiding surfaces and with the convex guiding surfaces.

18. A track-switching unit for allowing controlled and selective switching of a segment of a track or a guideway, comprising:

one or more rail-switching units of claim 1, a set of components linked to or part of an electronic operating control system, a first supporting structure;

wherein a number of the one or more rail-switching units is equal to a number of rails composing the segment of the track affected by the track-switching unit;

wherein when comprising more than one rail-switching unit and in a normal operating mode of the more than one rail-switching unit, the more than one rail-switching unit is meant to be operated in a simultaneous way wherein when comprising the more than one rail-switching unit and in the normal operating mode of the more than one rail-switching unit, the more than one rail-switching unit is meant to be operated congruently to create viable paths of continuity for the vehicles to move along the track;

and the first supporting structure supports, consolidates and protects elements comprised within the track-switching unit and, when appropriate, firmly attaches the elements within the track-switching unit to a ground or to common guideway structures or integrates the elements within the track-switching unit with the first supporting structure of the track-switching unit.

19. The track-switching unit of claim 18, wherein guideway rails are supported from an outside of the track, and sets of wheels of wheels-assemblies are wrapped around the guideway rails from an inside of the track; and wherein a width of the track or a maximal width of a vehicle body without considering the wheels-assemblies or a vehicle body width, are adapted to allow the vehicles, when directed through the track-switching unit, to fit within a horizontal gap between two rails of a same track and pass through the track-switching unit without any inadequate interferences; and wherein clearance gaps above and below rails are minimized fundamentally at the internal ends of the set of two, three or more branch fixed-rails; and a top height of the wheels-assembly is minimized to a height of top wheels of the wheels-assembly; and a bottom height of the wheels-assembly is minimized to a height of bottom wheels of the wheels-assembly, whilst always allowing the wheels-assemblies to pass through the track-switching unit without any inadequate interferences; and wherein tracks in diverging/merging points are progressively vertically distanced/approximated avoiding any lateral turns of the tracks in a portion of the guideway called a straight-guideways segment, wherein the straight-guideways segment is linked to the set of two, three or more branch fixed-rails and thus is adjacent to the track-switching unit; and wherein a longitudinal length of the straight-guideways segment is reduced by minimizing a top height of the vehicle body or minimizing a bottom height of the vehicle body; and wherein segments of the guideway adjacent to the track-switching unit or a general common guideway or the vehicles running through the track-switching unit are adapted as a consequence of directly or indirectly applying some or all of above limitations.

20. A track-switching system for allowing a coordinated and controlled selective switching of multiple track segments of a vehicle-guiding system, comprising:

one or more track-switching units of claim 18, the electronic operating control system, and a second supporting structure;

wherein the electronic operating control system manages the one or more track-switching units, comprising activating, coupling, verifying, maintaining and controlling a functioning of the one or more track-switching units and rail-switching units of the one or more track-switching units;

and wherein the second supporting structure supports, consolidates and protects elements comprised within the track-switching system and, when appropriate, firmly attaches the elements within the track-switching system to a ground or to the common guideway structures or integrates the elements within the track-switching system with the first supporting structure of the one or more track-switching units.

* * * * *